US007469108B2

(12) United States Patent
Kawasaki et al.

(10) Patent No.: US 7,469,108 B2
(45) Date of Patent: Dec. 23, 2008

(54) SHEET MATERIAL DISCRIMINATION APPARATUS, SHEET MATERIAL INFORMATION OUTPUT APPARATUS, AND IMAGE FORMING APPARATUS

(75) Inventors: Takehiko Kawasaki, Atsugi (JP); Norio Kaneko, Atsugi (JP); Naoyo Gemma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 367 days.

(21) Appl. No.: 11/442,308

(22) Filed: May 30, 2006

(65) Prior Publication Data

US 2006/0275045 A1 Dec. 7, 2006

(30) Foreign Application Priority Data

Jun. 3, 2005 (JP) ..... 2005-163766
Apr. 19, 2006 (JP) ..... 2006-116231

(51) Int. Cl.
*G03G 15/00* (2006.01)

(52) U.S. Cl. ..... 399/45

(58) Field of Classification Search ..... 399/45, 399/322, 320, 67, 68
See application file for complete search history.

(56) References Cited

U.S. PATENT DOCUMENTS 6,385,406 B1 * 5/2002 Funamizu et al. ..... 399/45
6,397,021 B2 5/2002 Hayashi et al. ..... 399/69
6,574,569 B1 * 6/2003 Omata et al.
7,152,861 B2 12/2006 Kawasaki ..... 271/262
7,204,124 B2 4/2007 Gemma ..... 73/12.01
7,239,817 B2 * 7/2007 Kaneko et al. ..... 399/45
2003/0053090 A1 3/2003 Nojiri et al. ..... 358/1.9
2006/0016996 A1 1/2006 Kaneko et al. ..... 250/339.1
2006/0022400 A1 2/2006 Kawasaki et al. ..... 271/227
2006/0054842 A1 3/2006 Kawasaki et al. ..... 250/559.04
2007/0023996 A1 2/2007 Kawasaki ..... 271/262
2007/0036567 A1 2/2007 Kawasaki et al. ..... 399/45

FOREIGN PATENT DOCUMENTS

JP 2004-26486 1/2004
JP 2005-24550 1/2005
WO WO 2004059296 A2 * 7/2004

* cited by examiner

*Primary Examiner*—Susan S Lee
(74) *Attorney, Agent, or Firm*—Fitzpatrick, Cella, Harper & Scinto

(57) ABSTRACT

Provided is a sheet material discrimination apparatus including: an impact force applying member for colliding with the surface of a sheet material, an impact force receiving member for receiving the impact force applying member through the sheet material, a detecting unit for outputting an electric signal corresponding to an impact force received by the impact force receiving member, and a cushioning material for absorbing the impact force transmitted to the detecting unit, wherein a support member having a bending rigidity higher than the bending rigidity of the detecting unit with respect to the impact force is arranged between the detecting unit and the cushioning material.

11 Claims, 12 Drawing Sheets

SHEET MATERIAL DISCRIMINATION APPARATUS, SHEET MATERIAL INFORMATION OUTPUT APPARATUS, AND IMAGE FORMING APPARATUS

BACKGROUND OF THE INVENTION

1. Field of the Invention

The present invention relates to a sheet material discrimination apparatus for allowing an impact force applying member to collide with a sheet material and detecting an impact force through a sheet material by a detecting unit such as a piezoelectric element, and more particularly, to a technology of improving stability of an output of a piezoelectric element to enhance a discrimination accuracy.

2. Related Background Art

In an image forming apparatus adopting an electrophotographic system, an image forming apparatus adopting an ink jet system, a printing apparatus, and the like, it is preferable to automatically discriminate a sheet material to be processed and adjust an image forming condition, a treating condition, a conveying speed, and the like. Then, various sheet material discrimination apparatuses for automatically discriminating a sheet material have been proposed.

Japanese Patent Application Laid-open No. 2004-026486 discloses a sheet material discrimination apparatus for detecting an impact force caused when an impact force applying member is allowed to collide with a sheet material by a piezoelectric element. In this case, a sheet material is discriminated by detecting a voltage output generated when the piezoelectric element receives an impact force to be deformed by bending.

Japanese Patent Application Laid-open No. 2005-024550 discloses a sheet material discrimination apparatus for allowing an impact force applying member to collide with a sheet material to detect an impact force through a sheet material by a piezoelectric element. In this case, the piezoelectric element is sandwiched between an impact force receiving member and a cushioning material, and a compressive force due to the impact force received by the impact force receiving member through the sheet material affects on a whole surface of the piezoelectric element. The cushioning material absorbs the impact force received by the piezoelectric element to prevent a noise and a vibration of a casing.

U.S. Pat. No. 6,397,021 discloses an image forming apparatus for forming an image on a sheet material. In this case, an image is formed in an image forming part, and then temperature of a heat roller of a fixing device for fixing a transferred toner image on a sheet material is detected to control the temperature of the heat roller based on the detected temperature.

In the sheet material discrimination apparatus disclosed by Japanese Patent Application Laid-open No. 2004-026486, a piezoelectric element is positively deformed by bending due to an impact force of an impact force applying member to obtain a large output. However, the piezoelectric element is allowed to be arbitrarily deformed by bending, whereby the piezoelectric element may cause a bending vibration due to an impact force and a contact with the sheet material. Due to the bending vibration of the piezoelectric element, a complicated vibration mode is formed in a plane of the piezoelectric element, to thereby generate a large spike noise which is superimposed on the output of the piezoelectric element. As a result, in a simple output processing for simply detecting peak values and sorting the obtained values, a measurement result high in reproducibility is not be obtained, and a resolving ability for discriminating a sheet material is lowered.

In the sheet material discrimination apparatus disclosed by Japanese Patent Application Laid-open No. 2005-024550, because bending and deformation are constrained by an impact force receiving member, a bending vibration of the piezoelectric element is less likely to be caused. However, when a height of a detecting part, which includes a cushioning material by reducing a width of the impact force receiving member, is to be reduced, a bending rigidity of the piezoelectric element becomes insufficient, whereby a vibration is more likely to be caused. An output of the piezoelectric element becomes a value corresponding to a combined stress for every deformation such as a slip, shearing, compression, and bending of the piezoelectric element. Therefore, in view of extracting a signal component with a good SN ratio in a single mode, it is considered that a component of another mode is included as a noise component.

Therefore, by focusing on a compressing transformation of a stress of a piezoelectric element, the present invention has been made with a structure in which a detecting unit for extracting only a compressional component is provided, and a stable output with less noises is obtained.

Extracting only a compressional component according to the present invention includes not only a case of extracting only compressional components (100% compressional component) but also a case where a compressional component is predominant among the extracted.

SUMMARY OF THE INVENTION

A sheet material discrimination apparatus according to the present invention includes: an impact force applying member for colliding with a surface of the sheet material; an impact force receiving member for receiving the impact force applying member through a sheet material; a detecting unit for outputting an electric signal corresponding to an impact force received by the impact force receiving member; and a cushioning material for absorbing the impact force transmitted to the detecting unit, wherein a support member having a bending rigidity higher than a bending rigidity of the detecting unit with respect to the impact force is arranged between the detecting unit and the cushioning material.

The cushioning material according to the present invention is also called a damper member.

DESCRIPTION OF THE PREFERRED EMBODIMENTS

Hereinafter, a sheet material discrimination apparatus according to the embodiments of the present invention will be described in detail with reference to the drawings. The sheet material discrimination apparatus according to the present invention is not limited to a definite structure according to the embodiments described below. As long as an impact force applying member is allowed to collide with a sheet material to detect an impact force through a sheet material by a detecting unit such as a piezoelectric element, any member according to another embodiment in which a part of or the whole of the present embodiments are replaced with an alternative structure thereof, can be also realized.

In this embodiment, an example of the sheet material discrimination apparatus installed in an image forming apparatus adopting an electrostatographic system will be described. However, the sheet material discrimination apparatus 10 according to this embodiment can be also installed in an image forming apparatus adopting an ink jet system, various printing apparatuses, a sheet material processing apparatus, a sheet material mounting apparatus, a sorter, and the like.

It should be noted that, with regard to a structure for each part of the sheet material discrimination apparatuses, signal processings, control flows of a sheet material discrimination, and the like which are disclosed by Japanese Patent Application Laid-open No. 2004-026486 and Japanese Patent Application Laid-open No. 2005-024550, drawings and detailed explanation thereof will also be omitted to avoid complication by repeated explanation.

First Embodiment

Figure 7:
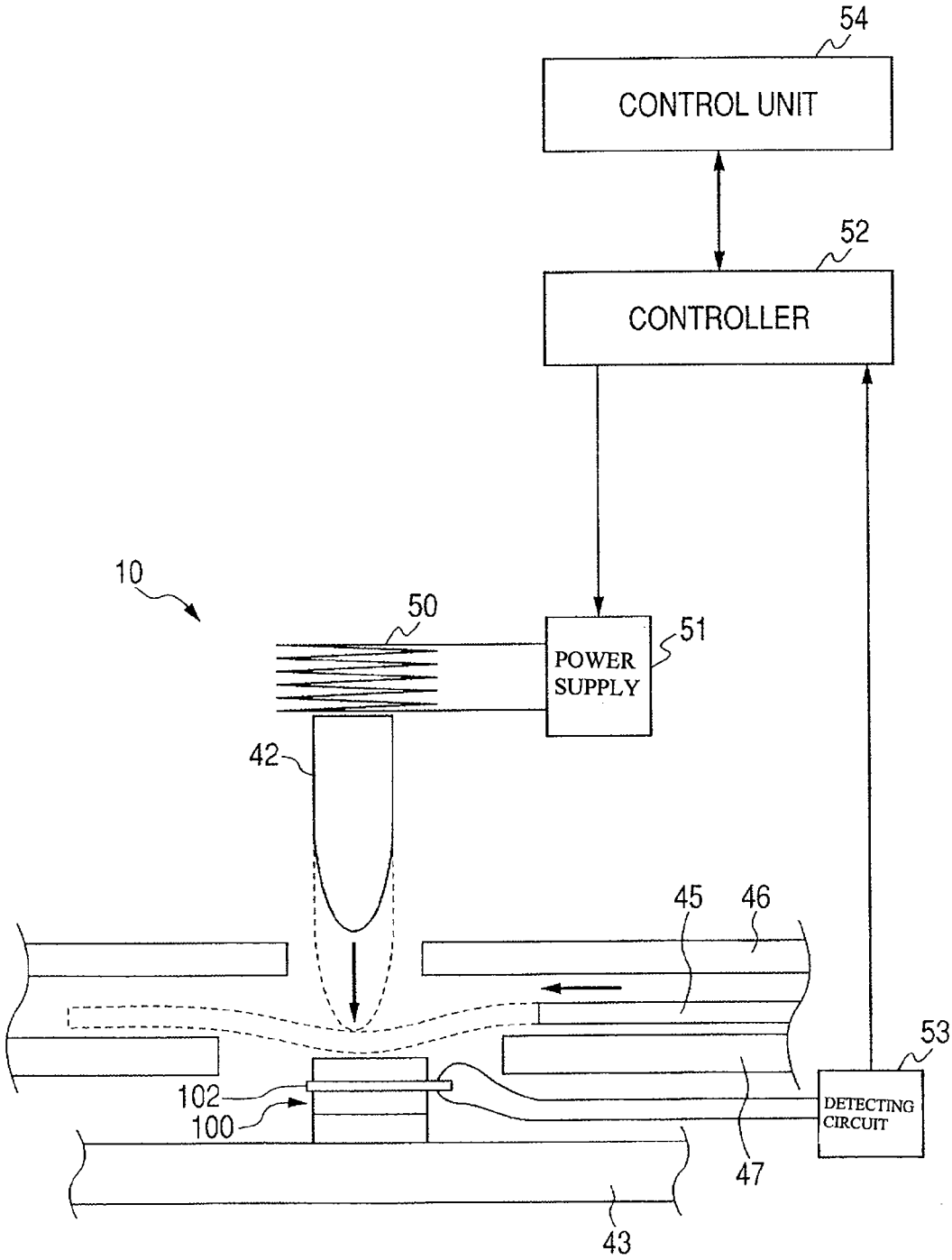
FIG. 7 is an explanatory diagram of a structure of a sheet material discrimination apparatus according to a first embodiment.
Figure 8:
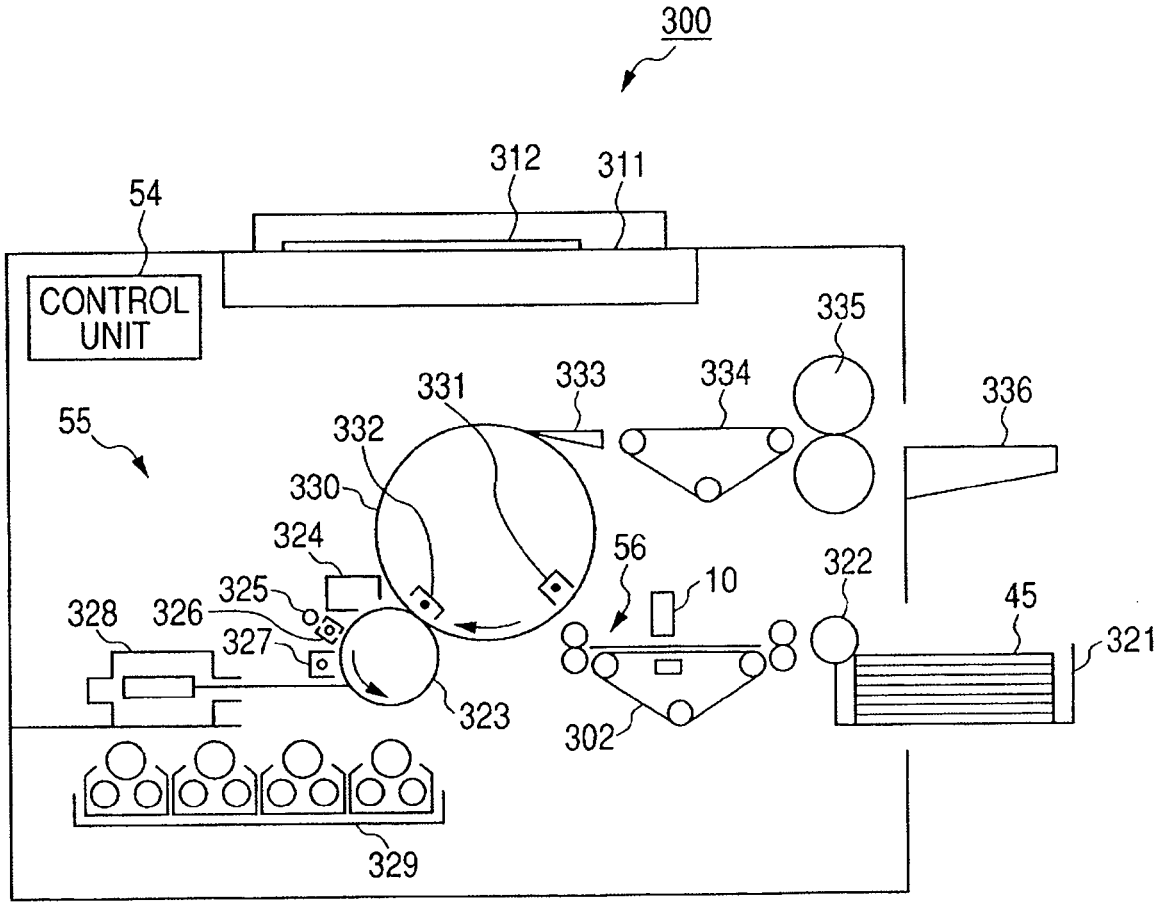
FIG. 8 is an explanatory diagram of a structure of an image forming apparatus mounted with the sheet material discrimination apparatus.
Figure 9:
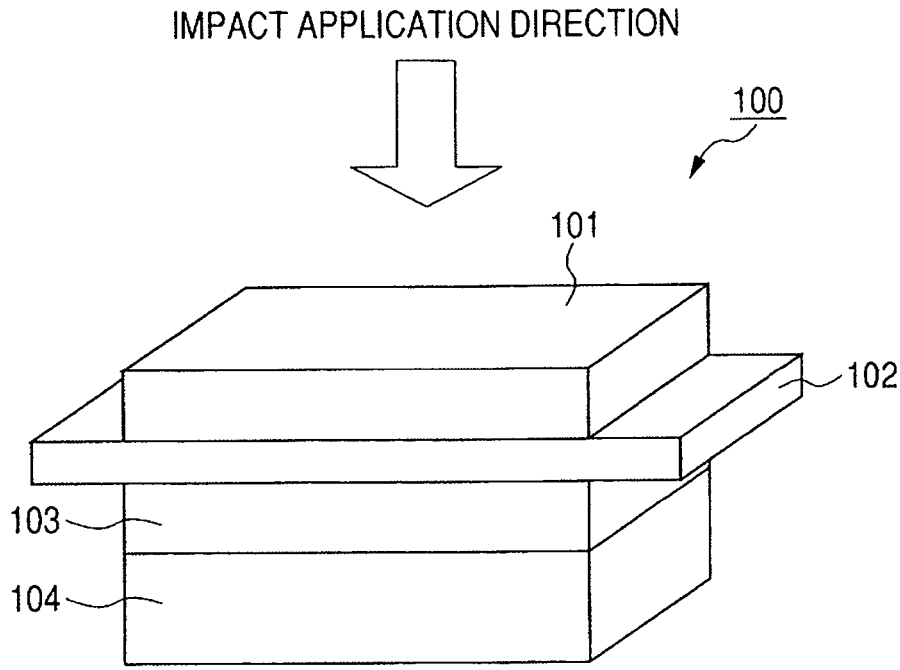
FIG. 9 is a perspective view of a detecting unit.
Figure 10:
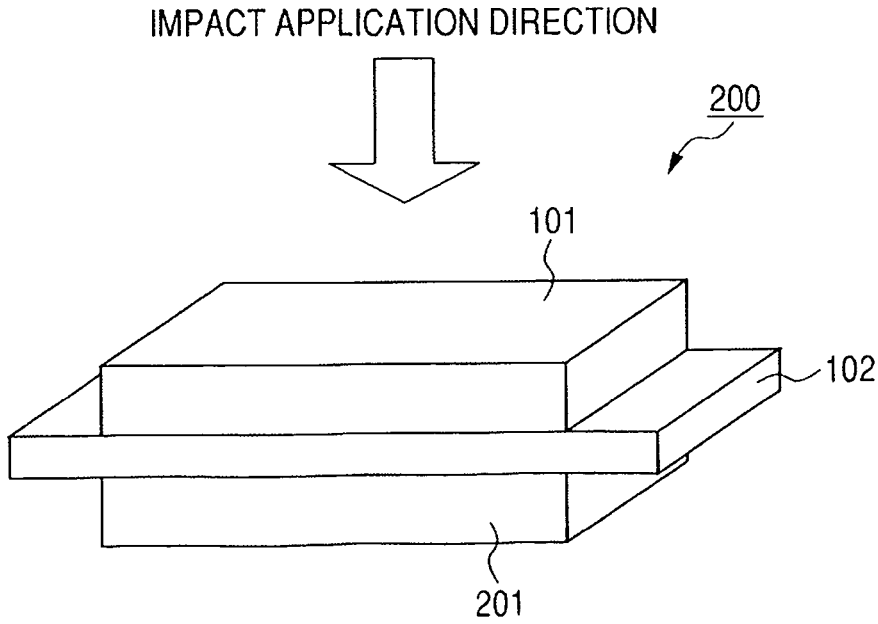
FIG. 10 is a perspective view of a detecting unit according to a comparative example.
Figure 11:
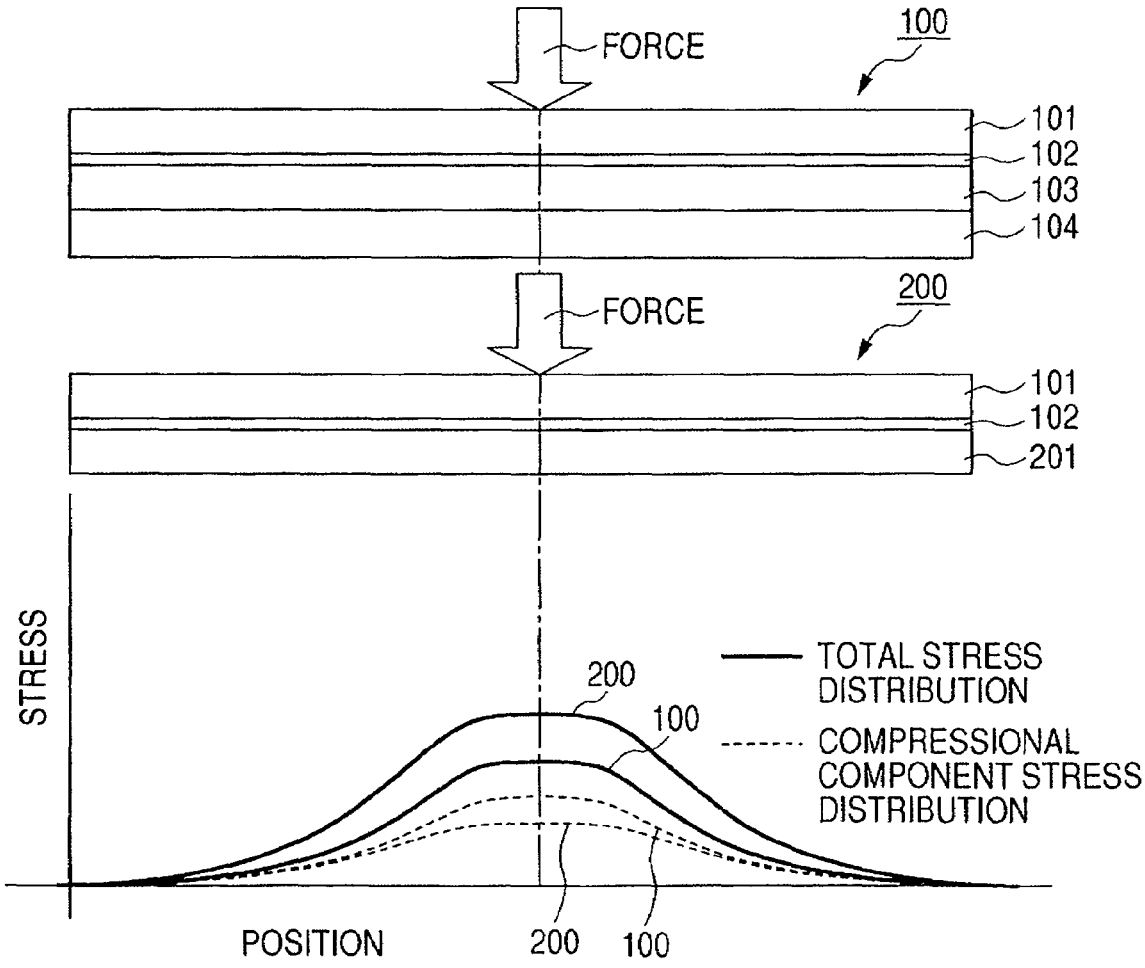
FIG. 11 is a diagram showing stress distributions of piezoelectric elements according to the first embodiment and the comparative example for comparison.
Figure 12:
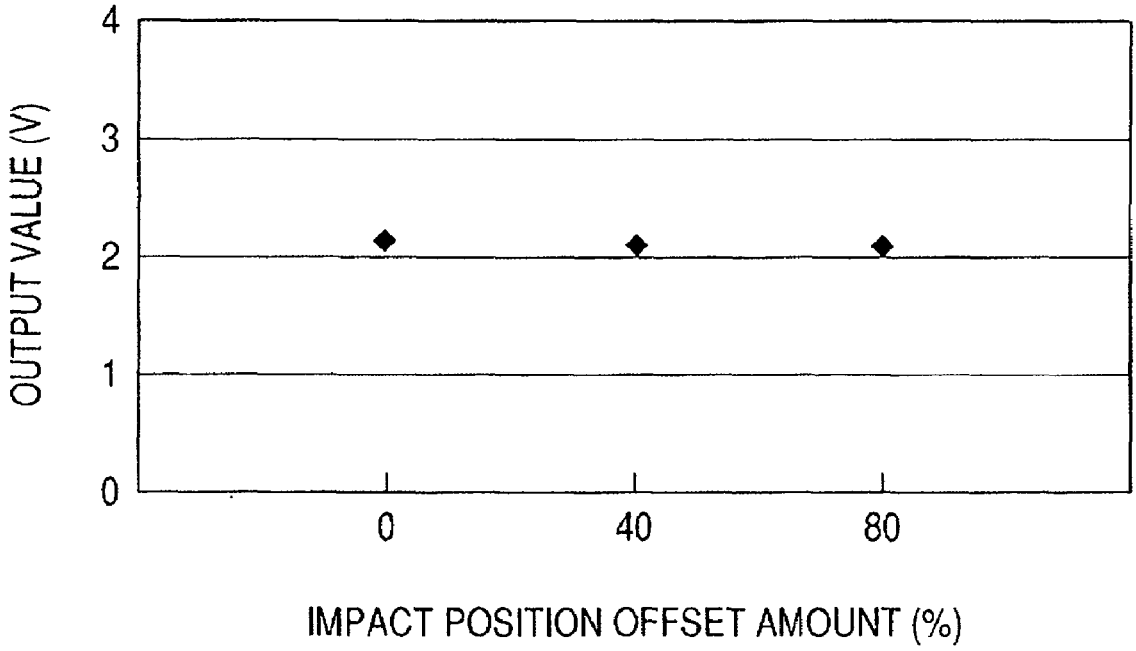
FIG. 12 is a graph showing a dependency of a piezoelectric element output according to the first embodiment on an impact position offset amount.
Figure 13A:
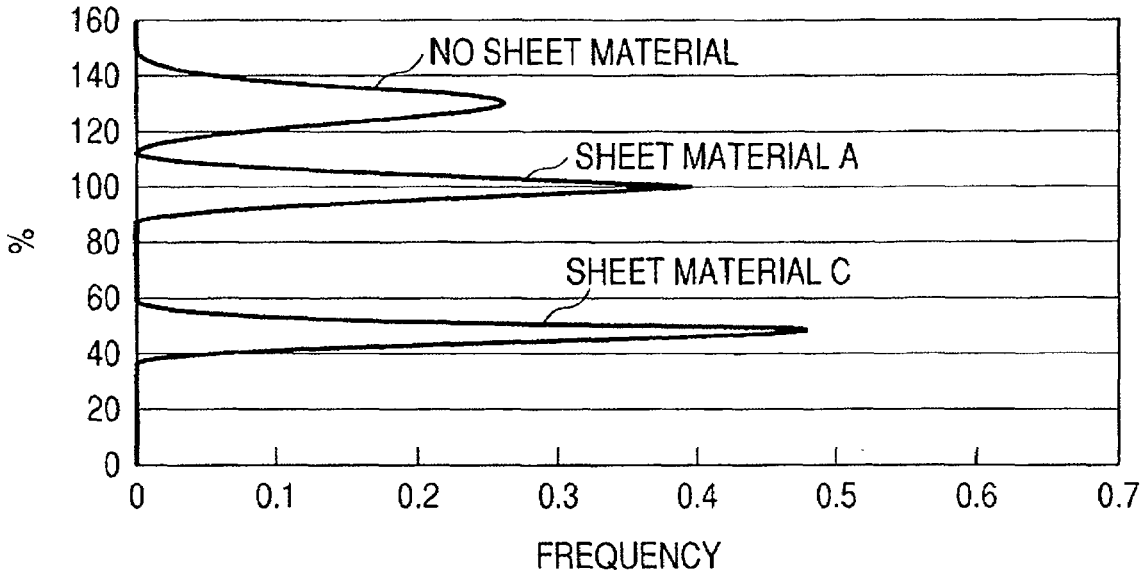
FIGS. 13A and 13B are diagrams showing distributions of peak values of out put of the piezoelectric elements according to the first embodiment and the comparative example, respectively, for comparison.
Figure 13B:
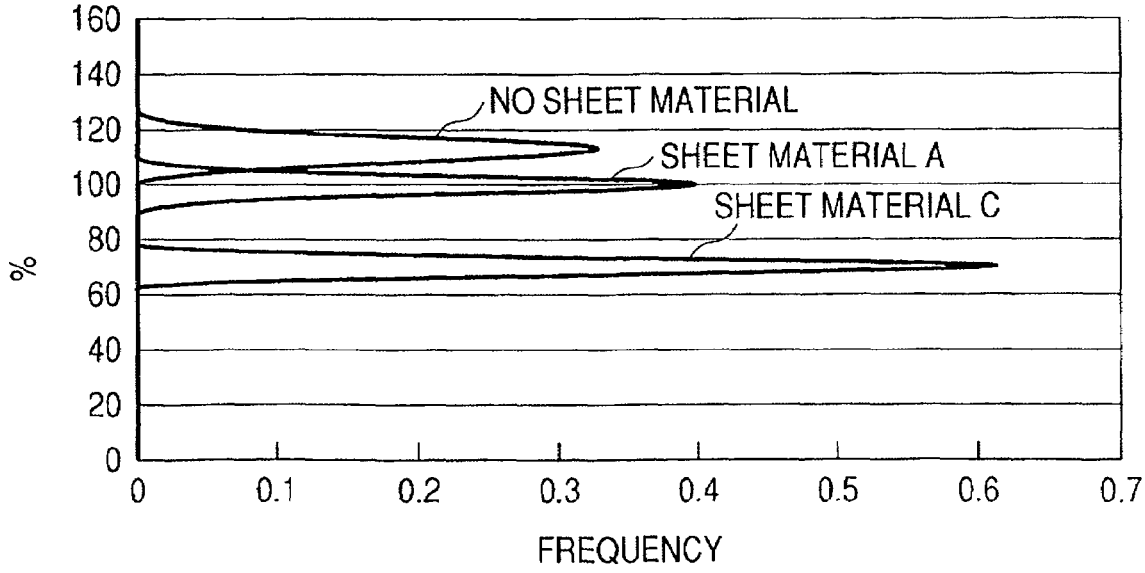
Figure 14:
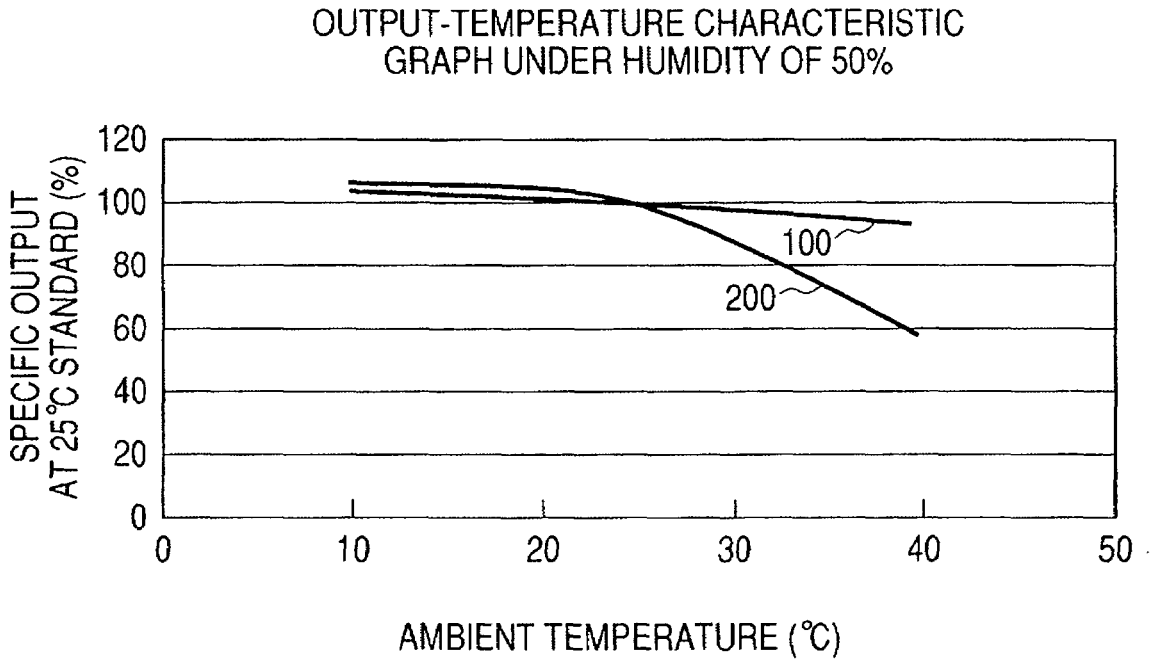
FIG. 14 is a graph showing relationships between output and temperature of the piezoelectric element according to the first embodiment and the comparative example.

FIG. 7 is an explanatory diagram of a structure of a sheet material discrimination apparatus 10 according to a first embodiment, and FIG. 8 is an explanatory diagram of a structure of an image forming apparatus including the sheet material discrimination apparatus 10. FIG. 9 is a perspective view of a detecting unit, and FIG. 10 is a perspective view of a detecting unit according to a comparative example. FIG. 11 is a diagram for comparison, showing stress distributions of piezoelectric elements according to the first embodiment and the comparative example, and FIG. 12 is a graph showing an output of the piezoelectric element according to the first embodiment. FIGS. 13A and 13B are diagrams for comparison, showing distributions of peak values of the piezoelectric elements according to the first embodiment and the comparative example, respectively, and FIG. 14 is a graph showing relationships between an output and temperature of the piezoelectric element according to the first embodiment and the comparative example.

Figure 1:
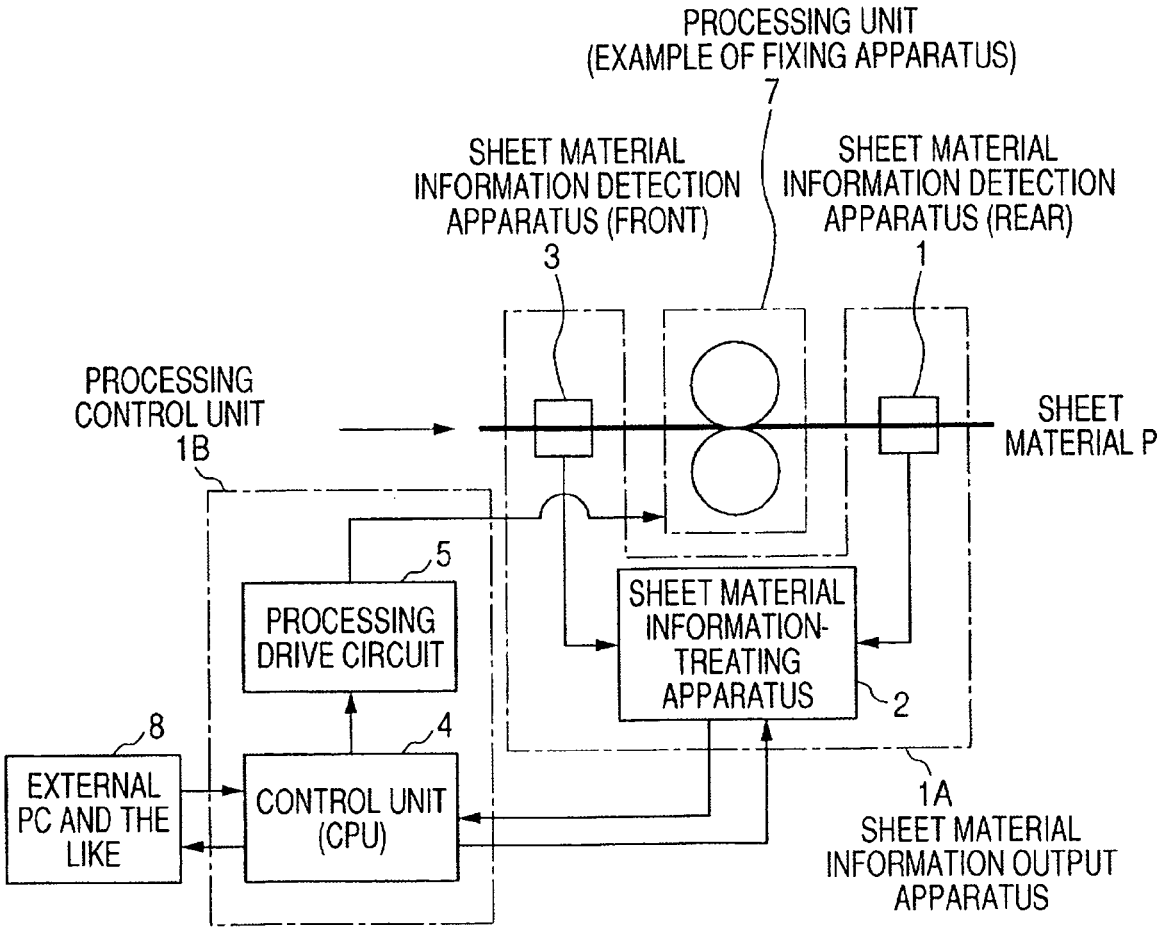
FIG. 1 is a diagram showing a structure of a sheet material treating apparatus such as an image forming apparatus according to an embodiment of the present invention.

As shown in FIG. 7, a sheet material 45 passes between a sheet conveying guides 46 and 47 which are formed to have a predetermined gap, and the sheet is transported and guided to an image formation processing unit 7 (FIG. 1) by a transport roller (not shown) at a predetermined speed in a direction indicated by an arrow of FIG. 1.

An impact force applying member 42 is formed of a material of a metal or the like. The impact force applying member 42 is generally held by a magnetic force generated by causing a current to flow through a coil 50 by a power supply 51, and waits at a position indicated by a solid line. However, when the current generated from the power supply 51 is stopped, a magnetic force of the coil 50 vanishes, and the impact force applying member 42 starts to fall freely by gravity. After that, the impact force applying member 42 collides with the sheet material 45 to deform the material 45 to be bent downwardly (a position indicated by a dotted line).

A detecting unit 100 is fixed on a casing 43, and receives an impact force due to a collision caused by the impact force applying member 42 through the sheet material 45. The piezoelectric element 102 is deformed by the impact, thereby changing a capacitance between electrodes sticked to both surfaces of the piezoelectric element 102. The capacitance change is converted into a voltage signal by a detecting circuit unit 53 (charge amplifier).

A controller 52 detects a peak voltage of a voltage signal in the detecting circuit unit 53, discriminates a sheet material, and then outputs a discrimination result to a control unit 54 of an image forming apparatus 300 shown in FIG. 8. The control unit 54 controls the image forming apparatus 300 based on the discrimination result of the sheet material.

As shown in FIG. 8, in the image forming apparatus 300 according to this embodiment, an image is formed on a sheet material in an image formation processing unit 55. A reading unit 311 reads image information of a color original 312. The read information is converted into a color gradation signal corresponding to toners of four colors which are Cyan, Magenta, Yellow, and Black.

The sheet material 45 contained in a cassette 321 is transported to a conveyor belt 302 by a transmission roller 322, and then is transported to a transfer drum 330 by the conveyor belt 302. A dielectric sheet is provided around a surface of the transfer drum 330. The sheet material 45 is absorbed and carried by the transfer drum 330 by an absorbing corona charger 331. A toner image formed on a photosensitive drum 323 is transferred onto a sheet material 45, which is absorbed and carried by the transfer drum 330 by an action of a transferring corona charger 332.

A surface of the photosensitive drum 323 is cleaned by a blade cleaner 324. After that, a pre-exposure lamp 325 and a pre-charge eliminator 326 remove an effect of a previous image formation remaining in the photosensitive drum 323, and a primary charger 327 uniformly charges a surface of the photosensitive drum 323.

A laser beam scanner 328 scans the surface of the photosensitive drum 323 through a laser beam modulated by an image signal generated from each color gradation signal read out to form an electrostatic latent image.

A developing device 329 is constituted of four developing units having a single color of Cyan, Magenta, Yellow, or Black, respectively. The developing unit corresponding to each color moves beneath the photosensitive drum 323 to develop the electrostatic latent image formed on the photosensitive drum 323 into a toner image.

While the sheet material 45 is absorbed and held by the transferring drum 330, the four color toner images are sequentially transferred onto the sheet material 45. After the four color toner images are finished to be transferred, a separation claw 333 is activated to separate the sheet material from the transfer drum 330. The separated sheet material 45 is transported into a heating roller fixing device 335 by the conveyor belt 334, whereby the toner image is fixed on a surface of the sheet material 45 by applying heat and pressure.

The sheet material 45 after fixation is discharged to a tray 336. A residual toner on the surface of the photosensitive drum 323 after transferring is cleaned by the blade cleaner 324 and is prepared for a next image formation cycle.

The sheet material discrimination apparatus 10 is arranged on a sheet material conveying path 56 for guiding a sheet material to the image formation processing unit 55 from the cassette 321. The control unit 54 controls an applied voltage of the transfer corona charger 332 and a fixing temperature of the heating roller fixing device 335 corresponding to a discrimination result of the sheet material 45 by the sheet discrimination device 10. The image forming apparatus 300 optimizes the charged amount and the fixing temperature corresponding to the sheet material 45, thereby making it possible to perform high quality image formation.

As shown in FIG. 9, in the detecting unit 100 according to the first embodiment, the piezoelectric element 102 is sandwiched between an impact force receiving member 101 and a support member 103, and is connected to a damper member (cushioning material) 104 beneath the support member 103. The impact force receiving member 101 and the support member 103 each has a square shape with a side length of 5 mm and is sticked to the piezoelectric element 102 by aligning the plane positions thereof. A thickness of the impact force receiving member 101 is 1.5 mm, and a thickness of the support member 103 is 2 mm.

The impact force receiving member 101 is a member for dispersing an impact force in a wide range of a top surface of the piezoelectric element 102 to protect the piezoelectric element 102. As the impact force receiving member 101, a metal having Young's modulus of 100 Gpa or more is generally used. The piezoelectric element 102 converts a stress due to an impact force of a collision by the impact force applying member 42 into an electric signal to be outputted. The support member 103 is a member for supporting the piezoelectric element 102 and having Young's modulus of 100 Gpa or more.

The support member 103 which can be suitably used in the present invention includes metallic materials such as steel products, a copper, and a stainless steel (for example, SUS 304). Ceramic materials such as alumina and zirconia, and a sintered material which mainly consists of alumina and zirconia and is high in rigidity, are suitably used. The damper material 104 to be used is made of a rubber material having Young's modulus of 10 Mpa, so the impact force received from the piezoelectric element 102 through the support member 103 is absorbed not to be transmitted to the casing structure 43 (FIG. 7). The damper member 104, which is made of a rubber material having a so-called high tan δ (having a high coefficient of impact force absorption), also prevents noise and vibration, and prevents the vibration of the casing structure 43 from affecting the piezoelectric element 102.

A material suitably used for the damper member (cushioning material) 104 in the present invention includes a polymeric material having viscoelasticity, and a rubber material such as a silicone rubber and a nitrile-butadiene rubber. In addition, a material obtained by expanding these rubber materials is also suitably used. A hardness of the rubber is preferably a durometer A (shore A) hardness of 90 or less, but may vary as long as a rubber shape stability can be maintained. Any gel material which is made of a polymeric material and has a sufficient shape stability may be used, and αGEL (registered trademark of GELTEC CO., Ltd.) or the like is suitably used.

In the detecting unit 100 of the sheet material discrimination apparatus 10 according to the first embodiment, the piezoelectric element 102 is pressed on planes vertical to a direction of applying the impact force by the impact force receiving member 101 and the support member 103, whereby the stress involving mostly a compressional stress is generated in the piezoelectric element 102.

In this case, when the Young's modulus of the support member 103 is low, the support member 103 is easily deformed integrally with the piezoelectric element 102 by a bending strength and a shearing strength, whereby the piezoelectric element 102 cannot be pressed on the planes vertical to the direction of applying the impact force. As a result, the stress involving only the compressional component is not to be extracted.

Further, when the Young's modulus of the damper member 104 is higher than that of the impact force receiving member 101, the piezoelectric element 102 and the support member 103, the damper member 104 is affected by an excitation to the casing structure 43 and an excitation to the piezoelectric element 102 from the casing structure 43. However, when the Young's modulus is too low, a height of the impact force receiving member 101 is lowered by the deformation due to its own weight, thereby messing up an impact condition of the impact force applying member 42. Accordingly, the damper member 104 preferably has as small Young's modulus as possible in a range of securing a position of a height of the impact force receiving member 101 with high accuracy.

A detecting unit 200 according to a comparative example shown in FIG. 10 can be installed to the sheet material discrimination apparatus 10 shown in FIG. 7 in replace of the detecting unit 100 shown in FIG. 9. By aligning the height of the impact force receiving member 101 and allowing the impact force applying member 42 to fall, the impact force through the sheet material 45 is measured.

As shown in FIG. 10, the detecting part 200 is composed of the impact force receiving member 101 which is the same member as in the first embodiment, the piezoelectric element 102 which is the same member as in the first embodiment, and a damper/support member 201, wherein the piezoelectric element 102 sticks to the impact force receiving member 101 and the damper/support member 201 directly sticks to the piezoelectric member 102. Between the members and between the members and the casing structure 43 (FIG. 7) are bonded through adhesion.

As shown in FIG. 11, a comparison is made between a total stress distribution of the piezoelectric element 102 and a compressional component stress distribution with respect to the sheet material discrimination apparatus 10 mounted with the detecting unit 100 and the sheet material discrimination apparatus 10 mounted with the detecting unit 200 according to the comparative example. A simulation operation is performed using the above-mentioned dimensions and Young's modulus, assuming that a static force is added to each center of the detecting unit 100 and the detecting unit 200. The stress distribution represents the stress distribution from an edge to a center thereof, and a solid line indicates the total stress distribution and a dotted line indicates the compressional component stress distribution.

As a result, it turned out that, in the detecting unit 100 according to the first embodiment, as compared with the detecting unit 200 according to the comparative example, an integration value of the total stress is reduced, but a ratio of the compression stress to the total stress is remarkably increased. The ratio of the compressional component (integration value) to the total stress in the detecting unit 200 according to the comparative example is only 28%, but the ratio of the compressional component in the detecting unit 100 according to the first embodiment reaches about 73%. The detecting unit 100 according to the first embodiment makes a strain other than the compression in the piezoelectric element 102 considerably reduced compared with the detecting unit 200 according to the comparative example, thereby activating the piezoelectric element 102 substantially in a compression single mode.

According to views of inventors of the present invention, an effect is obtained when the detecting part is structured such that the ratio of the compression stress to the total stress becomes 50% or more. When the detecting part is structured such that the ratio of the compression stress to the total stress is 70% or more, the piezoelectric element is activated substantially in the compression single mode. Here, the ratio of the compression stress means a proportion of signals based on the compressing transformation among the signals detected by the piezoelectric element.

The ratio of the compression stress will be further described. In FIG. 9, the piezoelectric element 102 is constituted of a piezoelectric ceramics plate and two thin electrodes provided on both surfaces of the plate (that is, a surface of the plate in contact with the impact force receiving member 101 and a surface of the plate in contact with the support member 103) of the piezoelectric element 102. Then, in the piezoelectric element 102, an electric charge generated in the thin electrodes by the stress applied to the piezoelectric ceramics plate is extracted as a voltage output.

The compression stress is a stress applied in a vertical direction of FIG. 9, that is, in a thickness direction of the piezoelectric element 102 (hereinafter, referred to as "y direction"). Another stress is an elastic stress (hereinafter, referred to as "elastic stress") in respective directions with respect to a plane direction of the plate of the piezoelectric element 102 (hereinafter, referred to as "x direction" as a whole) which is generated mainly when the whole element is bent. In the description of the present invention, the elastic stress is indicated not by adding the stresses applied to the x direction, but by using, as a representative value, the stress applied in one direction of the x direction of the piezoelectric element plate (or in the main elastic direction in a case where the piezoelectric element plate has an anisotropy in elasticity, such as in a case where the piezoelectric element plate has a longitudinal direction).

Assuming that the output voltage is denoted as V, the strain due to compression stress is denoted as Δy, and the strain due to elastic stress is denoted as Δx, voltage constants for indicating voltages generated in the electrodes with respect to the stresses in the respective directions are denoted as dx and dy, respectively. The generated voltage V of this case is represented by the following proportional expression.

$$V \propto \Delta x dx + \Delta y dy$$

The proportion of the output indicated by Δy in the above expression, that is, the proportion of the stress which derives Δydy/(Δxdx+Δydy) is the ratio of the compression stress.

FIG. 12 is a graph showing a dependency of an impact position offset amount on an output voltage value (peak value) of the piezoelectric element 102 when the impact force applying member 42 is allowed to collide with the detecting units 100 and 200 through the sheet material 45. In an example of FIG. 12, plain paper (4024 Premium Multipurpose White Paper 75 g/m$^2$, manufactured by Fuji Xerox Co., Ltd.) is used as the sheet material 45.

The impact position offset amount is a positional displacement amount when the detecting unit 100 and the impact force applying member 42 are relatively displaced for some reasons. In FIG. 12, the impact position offset amount is indicated as a relative value which is set to 0% in a case where the impact force applying member 42 is allowed to collide with a center of the detecting unit 100, and is set to 100% in a case where the impact force applying member 42 is allowed to collide with an edge of the detecting unit 100.

Such positional displacement of the impact is caused for various reasons such as an error during built-in, and a case where the impact force applying member 42 is drawn by a friction or the like generated by the conveying force of the sheet material 45. In the case of the detecting unit 200 (FIG. 10) according to the comparative example, the positional displacement of the impact causes a plurality of deformation modes to the piezoelectric element 102 of the detecting unit 100, and the deformation modes are interfered with each other. Thus, an output waveform of the piezoelectric element 102 is drastically changed at an impact offset position. As a result, the output voltage value is fluctuated to a large extent. However, in this embodiment (FIG. 9), the deformation mode other than the compressing transformation is controlled, and the fluctuation amount thereof is very small, whereby the stability of the output value is enhanced.

Therefore, there is no need to integrate the waveform and filter by a low-pass filter, and only by detecting and sorting out the V0 value which is a maximum value of the waveform, a measurement result high in reproducibility is obtained. Thus, a V0 value judgement area with a narrow width is arranged in high density, thereby making it possible to perform a detailed discrimination of the sheet material.

Next, a simulation operation is performed for applying an impact force to the sheet material 45 in the detecting units 100 and 200 which are different in structure from each other. A result of comparing an output frequency of the detecting unit 100 and that of the detecting unit 200 is shown in FIGS. 13A and 13B.

In this case, an output is a peak value of the output waveform of each of the detecting units 100 and 200 at the time of impact application. An average value and a standard deviation are calculated based on data obtained by 90 trials to represent as a distribution map. FIG. 13A shows a case of the detecting unit 100 and FIG. 13B shows a case of the detecting unit 200. As the sheet material 45, a sheet material A and a sheet material C which are different in basis weight and thickness from each other are used, and each distribution is represented by calculating the average value of the sheet material A as 100%.

The detecting unit 100 according to the first embodiment shown in FIG. 13A, as compared with the detecting unit 200 according to the comparative example shown in FIG. 13B, an interval of a frequency peak among each cases of no sheet material (idle collision), the sheet material A, and the sheet material C becomes long, and the proportion in which bottoms of the waveforms of the frequency peaks are superposed with each other is reduced. In the detecting unit 100, a width among the distributions is expanded to almost twice the size compared with the detecting unit 200, whereby the discrimination ability is increased and noises are decreased. For instance, the detecting unit 100 according to the first embodiment is capable of substantially completely discriminating the cases of no sheet material (idle collision) and the sheet material A although erroneous judgment increases in discriminating the cases because bottoms of the waveforms of the frequency peaks are superposed with each other in the detecting unit 200 according to the comparative example.

As apparent from the above result, the detecting unit 100 in which the support member 103 having Young's modulus of 100 Gpa is bonded to the damper member 104 is more excellent than the detecting unit 200 in which the piezoelectric element 102 is directly supported by the damper member 201. Further, with the structure of the detecting unit 100, the above experimental result is not obtained by using the support member 103 made of an aluminum member having Young's modulus of 70 Gpa. In order to obtain the above result, the Young's modulus of 100 Gpa or more is required.

Next, an output change of the detecting units 100 and 200 in a case where ambient temperature is changed will be described. A graph of FIG. 14 is obtained by plotting an average value (trial number is 100) of peak values of the outputs of the detecting units 100 and 200 at the time when a predetermined impact force is applied without the sheet material 45 under a predetermined condition of a humidity of 50%.

As shown in FIG. 14, the detecting unit 100 in which the support member 103 having Young's modulus of 100 Gpa is bonded to the damper member 104 having Young's modulus 10 Mpa has small temperature change. On the other hand, the detecting unit 200 in which the piezoelectric element 102 is directly supported by the damper member 201 has significantly large temperature change. As a result, it is confirmed that the detecting unit 100 is excellent in stability of the output in a wider range of ambient temperature as compared with the detecting unit 200.

As described above, the detecting unit 100 according to the first embodiment has a high SN ratio in the peak voltage measurement and excellent temperature characteristic as compared with the detecting unit 200 according to the comparative example.

Since the Young's modulus of the piezoelectric element 102 is several 100 Gpa, it is necessary that the Young's modulus of the support member 103 is set as high as possible, and the thickness thereof is also increased in order to increase a bending rigidity of the piezoelectric element 102. The impact force receiving member 101 and the support member 103 may be made of the same material and in the same size, but it is preferable that the support member 103 is made thicker than the impact force receiving material 101. In the first embodiment, the impact force receiving member 101, the piezoelectric element 102, and the support member 103 each having a square plate shape are superposed, but those having a disk shape, a rectangular shape, or the like may be used.

Up to now, an image forming apparatus such as a copying machine, a printer, or a facsimile includes one in which an image is formed on a sheet material such as glossy paper, coated paper, and a film-shaped transparent resin in addition to ordinary copying paper. In such the image forming apparatus in which an image is formed on various sheet materials, it is desired that the optimum image formation processing is performed corresponding to the variation of sheet materials. Accordingly, such the apparatus includes a sheet material discrimination apparatus for discriminating types of sheet materials, and performs image formation under the conditions of the conveying speed, the fixing temperature, and the like in accordance with the sheet materials after the types of the sheet materials are discriminated by the sheet material discrimination apparatus.

Japanese Patent Application Laid-open No. 2004-026486 discloses, as such the sheet material discrimination apparatus, one including an impact force applying part for applying an impact force to a sheet material from the outside and a detecting unit including a piezoelectric element for outputting an electric signal by the impact force. In this sheet material discrimination apparatus, information about the type of sheet material is obtained by allowing an impact force applying member to collide with a sheet material to apply an impact force to the sheet material, and by using a signal peak value or the number of peaks, or a time interval between the peaks due to the impact force which is obtained from the detecting unit. An example of the structure of the detecting part shows that an impact force receiving member with a plate shape, a piezoelectric element, and a support member for the piezoelectric element which also serves as a damper are superposed with one another in a three-layer to be bonded to a base on a side opposed to the impact force applying unit through the sheet material. As a damper/support member, a rubber member having Young's modulus of about 10 Mpa is mainly adopted.

However, in such the conventional sheet material discrimination apparatus, the output of the detecting unit becomes a combined stress of every modes such as a slip, shearing, compression, and bending of the piezoelectric element. Therefore, in view of extracting a signal component with an enhanced SN ratio in a single mode, it is assumed that components in the other modes are included as a noise component.

On the other hand, the sheet material discrimination apparatus according to the first embodiment has been made by focusing on the compressing transformation of the stress of the piezoelectric element 102. The structure of the detecting part 100 for extracting the compressional component, and the support member 103 are determined to obtain stable output with less noise.

<Correspondence with the Invention>

The sheet material discrimination apparatus 10 includes the impact force applying member 42 for colliding with a surface of the sheet material 45 and the impact force receiving member 101 for receiving the impact force applying member 42 through the sheet material 45. Further, the sheet material discrimination apparatus 10 includes the piezoelectric element 102 for outputting an electric signal corresponding to the impact force received by the impact force receiving member 101, and the damper member 104 for absorbing the impact force transmitted to the piezoelectric element 102. The sheet material discrimination apparatus 10 further includes the support member 103 having a higher bending rigidity than that of the piezoelectric element 102 with respect to the impact force is arranged between the piezoelectric element 102 and the damper member 104.

In the sheet material discrimination apparatus 10, since the bending rigidity of the piezoelectric element 102 is remarkably reinforced by the support member 103, so the stress other than compression hardly acts on the piezoelectric element 102. The output of the piezoelectric element 102 corresponds to the compression force received by a pressure-receiving surface of the piezoelectric element 102, and the output due to a slip, shearing, compression, and bending of the piezoelectric element 102 becomes considerably small as compared with the case where the support member 103 is not provided.

Therefore, since large-amplitude noises due to a bending vibration of the piezoelectric element 102 caused by impact are eliminated, the measured SN ratio is considerably enhanced, only by a simple detection of the peak value, as compared with the structure disclosed by Japanese Patent Application Laid-open No. 2004-026486 which allows the piezoelectric element 102 to be arbitrarily deformed by bending. The bending vibration of the piezoelectric element 102 caused by a friction with the sheet material 45 also becomes small, so that the output high in reproducibility is obtained irrespective of the surface property and material quality of the sheet material 45, and when the sheet material 45 is transported at a high speed, the sheet material 45 can also be precisely judged.

Further, since the damper member 104 and the piezoelectric element 102 are not directly in contact with each other, the output of the piezoelectric element 102 is less affected by the property change of the damper member 104 with the elapse of time or caused by temperature change. As a result, the damper member 104 can be selected from a wide range of options, thereby making it possible to design even a thin damper member 104 having enhanced effects of preventing noise and vibration.

The support member 103 is in contact with the piezoelectric element 102 on the plane area on which the impact force receiving member 101 is in contact with the piezoelectric element 102. Therefore, the bending stress and shearing stress due to displacement of a plan position between the support member 103 and the impact force receiving member 101 do not act on the piezoelectric element 102.

The support member 103 has a larger mass as compared with the impact force receiving member 101. Therefore, when the impact force is transmitted from the impact force receiving member 101, as compared with a case where the mass of the support member 103 is smaller than that of the impact force receiving member 101, a large compressive force due to inertia of the support member 103 having a large mass acts on the piezoelectric element 102.

The support member 103 has a larger bending rigidity than that of the impact force receiving member 101 with respect to the impact force. Therefore, when the impact force is transmitted from the impact force receiving member 101, as compared with a case where the bending rigidity of the support member 103 is smaller than that of the impact force receiving member 101, the bending stress which acts on the piezoelectric element 102 becomes small.

The support member 103 is made of a material having Young's modulus of 100 Gpa or more. Therefore, when the impact force is transmitted from the impact force receiving member 101, as compared with a case where the Young's modulus of the support member 103 is smaller than 100 Gpa, the bending stress which acts on the piezoelectric element 102 becomes small.

The image forming apparatus 300 includes the image formation processing unit 55 for forming an image on the sheet material 45. The sheet discrimination apparatus 10 is provided on the sheet material conveying path 56 at an upstream side of the image formation processing unit 55, and includes the control unit 54 for controlling the image formation processing unit 55 corresponding to the discrimination result of the sheet material 45 by the sheet material discrimination apparatus 10.

The sheet material discrimination apparatus 10 allows the impact force applying member 42 to collide with a surface of the sheet material 45, and the piezoelectric element 102 detects an impact force received through the sheet material 45, thereby discriminating the sheet material 45. The piezoelectric element 102 is not bent and deformed by the impact force but is deformed by compression, whereby the sheet material discrimination apparatus 10 detects the voltage signal outputted by the piezoelectric element 102 to discriminate the sheet material 45 based on the voltage signal.

Therefore, the noises due to bending and deformation which causes unstable output are eliminated, thereby making it possible to detect a peak voltage value with a high SN ratio. Even when high-speed integrating processing or low-pass filter processing or the like of the detected voltage waveform is not performed, the peak value is simply detected to be sorted, thereby making it possible to discriminate the sheet material with high accuracy and reproducibility.

Second Embodiment

FIG. 1 is a diagram showing a structure of a sheet material treating apparatus such as an image forming apparatus according to embodiments of the present invention. The sheet material treating apparatus includes a sheet material information output apparatus 1A, a processing unit 7 for performing processing such as image fixation or the like of the sheet material, and a processing control unit 1B.

The sheet material information output apparatus 1A includes a sheet material information detecting apparatus (rear) 1 for detecting the state of a sheet material P after being subjected to the processing by the processing unit 7. The sheet material information output apparatus 1A further includes a sheet material information treating apparatus 2 for receiving a signal from the sheet material information detecting apparatus (rear) 1 to output sheet material information.

In this case, the processing is, for example, an image formation processing in the image forming apparatus. The image formation processing includes fixation of toner on a sheet material, discharge of ink to the sheet material, and transportation of the sheet material in the image forming apparatus such as a copying machine. In addition, the processing of the present invention includes, for example, heating and/or pressurizing of the sheet material, and spraying ink (liquid) or the like in the image forming steps.

It should be noted that, when forming images on both surfaces of the sheet material, physical properties (rigidity or moisture content) of the sheet material after the image is formed on one surface of the sheet material is changed as compared with those before (i.e., when no image is formed on the surface of the sheet material). Therefore, according to the present invention, information of the sheet material after the processing is subjected thereto is detected, and the information is reflected on the processing conditions of the subsequent processing, thereby making it possible to form a more suitable image on a sheet material.

With respect to a plurality of sheet materials, the information (information on physical properties of paper, moisture content, temperature, or the like) of the sheet material after the processing is sequentially obtained. In a case where the information is changed above a predetermined value, it is possible to perform feedback control with respect to the processing.

Figure 2:
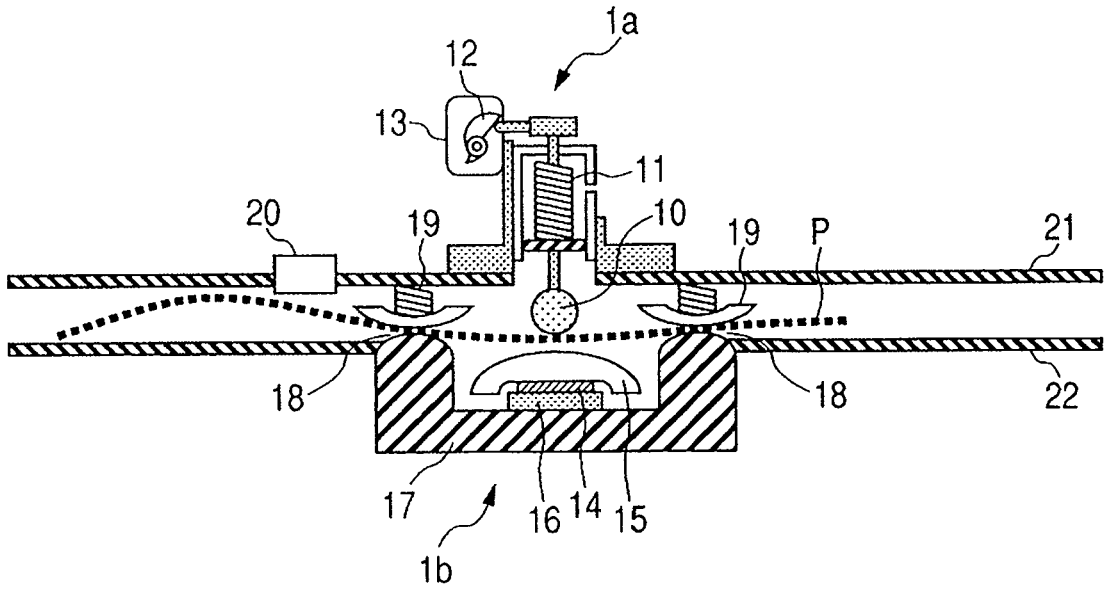
FIG. 2 is a view showing an example of a structure of a sheet material information detecting apparatus provided to a sheet material information output apparatus included in the sheet material treating apparatus.

In this case, it is preferable that a sheet material information detecting apparatus (rear) 1 capable of detecting dynamic properties of the sheet material in particular is used. FIG. 2 shows a preferable example of such the sheet material information detecting apparatus (rear) 1, and the sheet material information detecting apparatus (rear) 1 includes at least an external force applying member 1*a* for applying an external force on the sheet material P, and an external force detector 1*b* for detecting the external force applied by the external force applying member 1*a* through the sheet P.

An example of the sheet material information detecting operation in the sheet material information detecting apparatus (rear) 1 with the above structure is an operation in which the external force is applied to the sheet material P by the external force applying member 1*a* which is arranged to sandwich the sheet P, the thus applied external force is detected from a rear side of the sheet material P by the external force detector 1*b*, and information about the sheet material P is obtained based on the detection result by the external force detector 1*b*. A signal from the sheet material information detecting apparatus (rear) is obtained as, for example, a voltage waveform.

In this case, as the sheet material information detecting apparatus (rear) 1 according to the present invention may be, in addition to the above, one for detecting the moisture content of the sheet material, one for detecting a resistance value thereof, one for detecting a gloss thereof, one for detecting properties and troubles of an image in itself, one for detecting a hue thereof, and the like. That is, the sheet material information of the present invention includes information about an image formed on the sheet material and a result of processing such as working, in addition to the information about the sheet material in itself.

Figure 3:
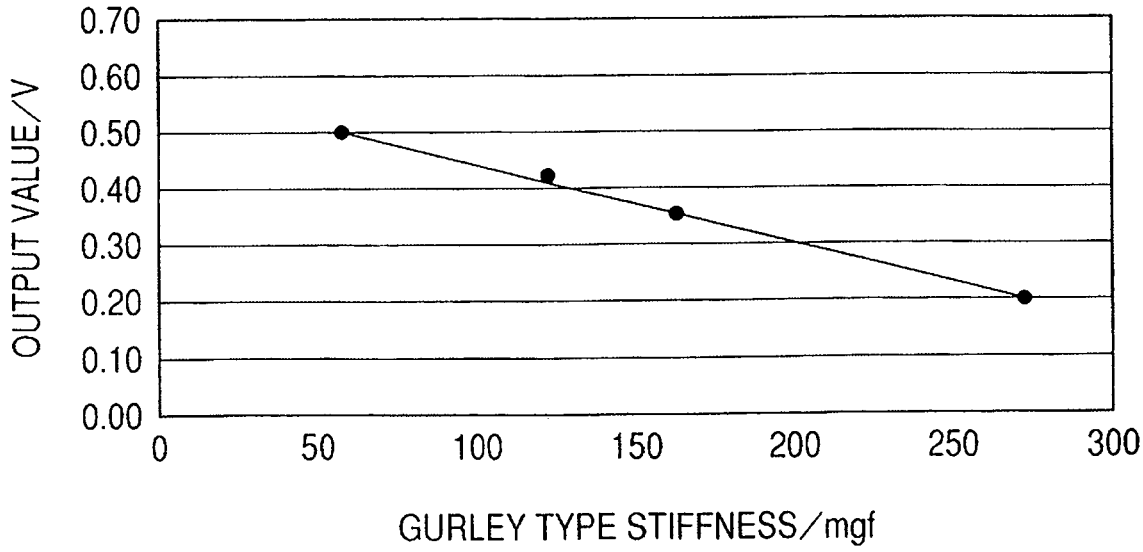
FIG. 3 is a graph showing an example of an output of the sheet material information detecting apparatus according to the present invention.

On the other hand, the sheet material information treating apparatus 2 treats a signal from the sheet material information detecting apparatus (rear) 1 and converts the signal into sheet material information necessary for a processing control to output the information. FIG. 3 shows an example of the sheet material information. FIG. 3 shows a mutual relation between an output voltage (V) from the external force detector 1*b* and a stiffness of the sheet material when a predetermined external force is applied to the sheet material in various conditions in the sheet material information detecting apparatus (rear) 1 shown in FIG. 2. In this description, the value measured by Gurley stiffness tester manufactured by Kumagai Riki Kogyo Co., Ltd. is used.

In other words, in the sheet material information treating apparatus 2, information is transformed as shown in FIG. 3, whereby the sheet material information detecting apparatus 1A is capable of outputting the stiffness of the sheet material. The information to be outputted is not limited to this, and includes types, density, thickness, and the like of the sheet material to be described below.

Further, the sheet material information treating apparatus 2 may be integrated with the sheet material information detecting apparatus (rear) 1, may be incorporated into a sheet material information treating apparatus as described below as a part of a CPU or the like, and may impart functions thereof to an external CPU or a network server.

In order to obtain the sheet material information with a higher accuracy, it is preferable that the state of the sheet material P before being subjected to the processing is obtained as information. In this case, the state of the sheet material P before being subjected to the processing can be estimated to some extent by, for example, inputting a model number of the sheet material P in advance, and by adding temperature/humidity separately measured by a sensor to the information.

However, when paper is adopted as the sheet material, for example, the paper quality gradually changes irreversibly due to repeated moisture absorption and drying, so that there is a case where the state of the sheet material P immediately before being subjected to the processing cannot be well reflected. Therefore, it is more preferable that there is provided a sheet material information detecting apparatus (front) 3 for detecting the state of the sheet material P before being subjected to the processing as shown in FIG. 1.

The sheet material information detecting apparatus (front) 3 is thus provided, and the state of the sheet material P before being subjected to the processing is obtained as information, whereby a change of the sheet material during the processing can be read out as a numeral value irrespective of an initial state of the sheet material, and the information can be outputted with a higher accuracy. A similar apparatus to the sheet material information detecting apparatus (rear) 1 is adopted as the sheet material information detecting apparatus (front) 3. Further, in a case where the sheet material passes through the same place before and after the processing because of a conveying path of the sheet material such as a double-sided copy by a copying machine using a return path, one sheet material information detecting apparatus may be provided at the same place of the conveying path for serving both of the sheet material information detecting apparatuses (front and rear). In this case, the number of errors due to individual difference of the sheet material information detecting apparatus is reduced, thereby enhancing the accuracy.

The above-described sheet material treating apparatus having at least the sheet material information output apparatus (rear) 1 and controls a sheet material treating condition corresponding to the sheet material information obtained from the sheet material information output apparatus (rear) 1 includes such apparatuses as described below. That is, there are an image forming apparatus, an image reading apparatus (a scanner and a page reader), a sheet transport apparatus (a sheet feeder), a sheet material number measuring machine, a sheet material kind separating machine, a sheet feeding apparatus, an information recording apparatus, an information reading apparatus, and the like.

Here, described below is about main processing and controlling of the sheet material to be controlled in an electrophotographic apparatus such as LBP and a copying machine which are an example of the image forming apparatus as a typical sheet material treating apparatus. Processing steps thereof include a step of transferring and attaching coloring materials such as toner onto the sheet material from a drum (hereinafter, referred to as "transferring processing"), and a step of fixing the color materials on the sheet material by heating and pressure (hereinafter, referred to as "fixing processing"). Other steps include a transporting step of transporting the sheet material through a predetermined conveying path and in a predetermined posture.

In addition, in association with the steps of forming an image, there are a step of correcting curl of paper, a step regarding book-binding such as stapling and sorting, and the like. Further, there is a step of adjusting a state of the sheet material which is stored in or outside the sheet material treating apparatus or is being transported (specifically, the moisture content in a case where paper is used as the sheet material, or the like). There are also a step of converting an inputted image information into a printing image used for an actual printing, and a step of performing image adjustment such as color balancing.

Further, the control may be performed for each step, or may be performed for a plurality of steps by considering a balance among the steps. Such controlling methods include a method of detecting the information of the sheet material after the processing, and then performing a feedback control for each processing step.

Thus, performed is the control for making the state of the sheet material or the image after being subjected to the processing at constant or in a preferable state. When the sheet material information exceeds the predetermined value, the control for stopping the processing or stopping the processing for a predetermined period of time is included.

On the other hand, the processing control unit 1B receives information from the sheet material information output apparatus 1A to control a sheet material treating condition. Such the sheet material treating condition includes, for example, adjustment of an image forming condition, adjustment of a transporting condition such as adjustment of the pressing force to a roller used for transporting, stopping of printing, stopping of transporting a recording medium, and generation of a warning signal.

In this case, a processing control unit 1B provided inside the sheet material treating apparatus or outside the sheet material treating apparatus may be used. However, in a case of using the processing control unit 1B provided inside the sheet material treating apparatus, transmitting/receiving of the data signal to/from the outside can be omitted. The processing control unit 1B may be connected to an external PC or the like as necessary.

Next, the control of the sheet material treating condition in the sheet material treating apparatus of the present invention will be described with reference to FIG. 1 by taking an image formation processing control of a double-sided copy as an example.

In this case, in a fixing processing for performing heating and pressurizing the sheet material P, the sheet material in itself suffers a change. To be specific, heating due to fixation increases the stiffness of the sheet by evaporation of moisture in a case where paper is used as the sheet material, or softens the sheet in a case where a resin material such as glossy paper is used as the sheet material, whereby the change of state greatly differs in the type of the sheets. The control of the fixing processing condition is performed in accordance with the information about the difference of such the change of state, thereby making it possible to perform sheet material processing such as image formation with a high quality.

In such the fixing processing control, the state of the sheet material P before being subjected to the fixing processing is first detected by, for example, the sheet material information detecting apparatus (front) 3, and a fixing temperature of a first surface to be fixed is set to the optimum condition based on the information. Subsequently, the state of the sheet material P after the fixing processing of the first surface is detected by the sheet material information detecting apparatus (rear) 1, and the detected condition is compared with the state of the sheet material P before the fixing processing, thereby obtaining the information about the change of the state of the sheet material P during the fixing processing of the first surface. By using the information, the fixing temperature of a second surface to be fixed is controlled to be an appropriate value.

The information about the sheet material after the fixing processing (processing) is detected by the sheet material information detecting apparatus (rear) 1, and the change of the sheet material by the processing is detected to control the processing, thereby making it possible to perform preferable processing of the sheet material.

The fixing processing conditions for controlling include not only a fixing condition for the second surface of the sheet material, but also a conveying condition of the sheet material, a transferring condition of the sheet material, and a condition of a method of mounting the sheet material. In a case where a plurality of sheet materials are processed in succession, a control may be performed under a processing condition of the sheet material to be processed after the processing of a first sheet material. Further, in a case where the change of the state of the sheet material P during the processing exceeds a predetermined allowable range, it is possible to stop the processing of a post-step or subsequent sheet material processings, or alarm when it is judged that the processing is abnormal.

The relationship between the processing unit 7 of the sheet material information output apparatus 1A and the sheet material information detecting apparatuses 1 and 3 can be arbitrarily determined in accordance with the design thereof. However, the state of the sheet material is changed or returned rather quickly due to its thinness, so that it is preferable that the sheet material is detected immediately before the processing to be controlled is performed.

Here, the sheet material according to the present invention means a whole material having a thin-plate shape, and it is possible to adopt sheet materials having any size such as a material cut into a predetermined size, and a material wound in a roll shape. Not only one piece of the sheet material, but also a sheet made by superposing or sticking two or more sheet materials with each other may be used. In particular, sheet materials to which the present invention is applied to obtain a large effect include a recording medium (for example, plain paper, glossy paper, coated paper, recycled paper, and OHP) or a manuscript.

In addition, the information about the sheet material includes not only information about the stiffness but also the information about kinds of the sheet material, density of the sheet material, thickness of the sheet material, a change of the state of the sheet material, printing state of the sheet material, presence or absence of double feeding, and the number of remaining sheets. The change of the state of the sheet material includes a change by absorption of moisture and drying, a change by elastic deformation or plastic deformation due to a dynamic force (extension, flexing, crushing, breaking, crimp, and the like). Further, the change of the state of the sheet material includes a change of physical property due to tension or compression added to the sheet material, a vibration, a deletion of components of the sheet material such as fiber or a coating material, an adhesion of a foreign matter to the sheet material, an adhesion condition of ink, toner, coating material, or the like, and other information necessary for the sheet material treating apparatus.

An external force applying member 1*a*, constituting the sheet material information detecting apparatuses 1 and 3, can apply the external force to the sheet material based on a contact of a solid external force applying member with the sheet material, or for spraying fluid such as air to the sheet material. It is preferable to use a driving source of the external force applying member 1*a* that drives the external force applying member by mechanical or electromagnetic energy. For instance, mechanical means such as a gravity and a spring, electromagnetic means such as a motor, a solenoid, a voice coil, and a combination of exchange mechanisms such as a cam, a shaft, and a gear are appropriately used. The most preferable example is a structure in which a hammer supported by a rotational bearing is accelerated by a motor and a cam.

Further, methods for applying an external force may include:

- a method of allowing an external force applying member arranged at a position away from a sheet material to collide with the sheet material
- a method of applying an impact force to the sheet material from the external force applying member in a state where the external force applying member is in contact with the sheet material.

In other words, in a step of detecting information, it is necessary that the external force applying member, the sheet material and the impact force receiving member are simultaneously brought into contact with each other at least once, but each positional relationship at other times may be arbitrarily set.

In addition, the above-mentioned application of the external force may be performed in any state described below.

a state where a sheet material remains stationary (for example, a state where the sheet material is stocked in a stocker)

a state where a sheet material is transported a state where the transported sheet material P is stopped once Here, in a case where the external force is applied to the sheet material P being transported, the external force applying member and the surface of the sheet material are in friction, thereby making it easy to detect the surface state of the sheet material. In addition, in a case where the external force is applied to the sheet material allowed to be stopped, noise components in association with the motion of the sheet material can also be reduced by an external force detector. Such the transporting condition is appropriately designed and controlled in accordance with necessary information.

Further, regarding the external force for application, one kind of external force may be used or a plurality of kinds of external forces may be used. The information of the sheet material may be obtained by applying the external force only once or may be obtained by applying the external force a plurality of times.

Here, in the case where the application of the external force is performed a plurality of times, for example, when one kind of external force is applied a plurality of times, or when a plurality of kinds of external forces are applied at different timings, a plurality of data is obtained, whereby the discrimination accuracy is also enhanced. Note that, in the case where the application of the external force is performed a plurality of times as described above, it is preferable that a subsequent application of the external force is performed after the motion of the sheet material due to the external force applied once is sufficiently attenuated, or after the motion of the sheet is reduced to equal to or less than a predetermined value.

Further, the external force detector 1*b* constituting the sheet material information detecting apparatuses 1 and 3 receives the external force directly from the external force applying member 1*a*, or receives the external force through the sheet material P, and includes a receiving member 15 having a function of propagating the external force to a pressure sensitive element 14 shown in FIG. 2. In an example of FIG. 2, planes of the receiving member 15 and the pressure sensitive element 14 are bonded together. However, in order to develop the function of the present invention, the receiving member 15 and the pressure sensitive element 14 may not be necessarily bonded to another member. The receiving member 15 may be structured to be a part of the pressure sensitive element 14, or the receiving member 15 and the pressure sensitive element 14 may be bonded together through a propagating member of some kind. Further, the receiving member 15 and the pressure sensitive element 14 may be bonded to a fixing member 16 as necessary and may be fixed to a pedestal 17.

Then, materials and shapes of the receiving member 15, the pressure sensitive element 14, the fixing member 16, and the like are appropriately selected, to thereby appropriately determine element characteristics. In this case, as the pressure sensitive element 14, preferable is an element for converting mechanical action such as pressure or vibration into an electric signal or an optical signal. As an example of such the element (electromechanical transducer) for converting the mechanical action into the electric signal, there are an element of a semiconductor diaphragm type, a capacitance type, an elastic diaphragm type, a piezoelectric type, or the like for use.

A preferable pressure sensitive element includes an element containing an inorganic material or an organic material having a piezoelectric property. Alternatively, inorganic materials such as lead zirconate titanate (PZT), PLZT, $BaTiO_3$, and PMN—PT ($Pb(Mg_{1/3}Nb_{2/3})O_3$—$PbTiO_3$), and an organic piezoelectric material may be used for the element. When the piezoelectric element is used, the external force is detected as a voltage signal. The detector for detecting the external force of this case includes a case where the detecting element itself is exposed or a case where the detecting element is coated or the like.

Further, as an element for converting the mechanical action into the light signal, used is an element which utilizes fluctuation of reflection of light from a member, or fluctuation of transmission or polarization from the member by a mechanical motion of the member. For example, suitable is a method in which laser light is applied to a member, and then a directional change of reflected light from the member is read by a light receiving element (split photodiode or the like) to read the motion of the member. In addition, also suitable is a method (so-called "laser Doppler velocimeter") in which two-beam laser light is applied to a member to read the motion speed of the member from the interference.

The receiving member 15 and the fixing member 16 are appropriately determined in accordance with the pressure sensitive element 14. As an example thereof, in a case where a piezoelectric ceramics plate is used as the pressure sensitive element 14, a member having a sufficiently higher rigidity (which is also called bending rigidity) than that of the pressure sensitive element 14 is used as the receiving member 15 and the fixing member 16. Such the member has a structure of adopting a deformation mode in which the pressure sensitive element 14 is compressed mainly in the thickness direction by the external force of the external force applying member.

In such the structure, the deformation by compression is mainly caused in the pressure sensitive element 14. In this case, the entire pressure sensitive element is compressed with respect to the applied force, so a difference in generated voltage in the areas where the external force is applied becomes relatively small, thereby making an effect in which an individual difference of the output vibration due to, for example, a common difference of assembly of an element can be suppressed.

Alternatively, other suitable examples of the pressure sensitive element 14 using the piezoelectric ceramics include the following structures. That is, it is possible to use an elastic body having an elasticity which is high enough to deform by bending the pressure sensitive member 14 as the receiving member 15, and a member to be elastically deformed, such as a rubber, can be used as the fixing member 16. Further, in a structure, for example, in which only one end of the pressure sensitive element 14 is fixed by the fixing member 16, adopted is a deformation mode in which the pressure sensitive member 14 is mainly elastically deformed in accordance with the bending deformation of the receiving member 15 by the external force by the external force applying member 1*a*. In such the structure, the pressure sensitive element 14 and the receiving member 15 operate substantially as a unimorph element, and a relatively high voltage mainly due to the bending deformation is obtained, thereby having an effect in which the S/N ratio of the signal processing is enhanced.

Further, as the fixing member 16, a member whose characteristics of hardness, viscoelasticity, resistivity, or the like is appropriately changed in accordance with a change of the environment such as temperature or humidity is selected, the output can be changed according to the environment, whereby the fluctuation of the output due to the environmental change of a sheet material can also be corrected.

A wiring (not shown) is led out from the pressure sensitive element 14. As the wiring, one having a high flexibility which prevents the pressure sensitive element 14 from being unnecessarily restrained is used, and the wiring is appropriately fixed to the pedestal 17.

In this case, the pedestal 17 preferably has a high rigidity and temperature stability, and materials thereof are appropriately selected from a metal or a resin. In order to appropriately dampen the vibration, it is also preferable that an insulation is placed. Note that the insulation may be placed at any position as long as it is possible to dampen the vibration. The pedestal 17 may be structured to have a shape which does not cause unnecessary resonance by the vibration from the external force application or from the outside. In addition, it is preferable that the vibration is shut off from the outside by a damper such as a rubber. Further, since the pedestal 17 opposes a backlash due to the external force application, the pedestal 17 preferably has equal to or more than a predetermined amount of inertial mass, and preferably has at least a mass larger than that of the external force applying member, and more preferably has a mass as five times as that of the external force applying member.

The sheet material detecting apparatus, for example, as described in Japanese Patent Application Laid-open No. 2004-26486, information about physical properties of the sheet material is obtained by utilizing the application of an impact force to the sheet material. In this case, it is preferable that, when an impact force applying part and an impact force receiving part are in contact with each other through the sheet material, the sheet material is bent so as to be in contact with both of the parts.

It is because a signal containing information about the compression of the sheet material and information about the bending is obtained.

When the information about the sheet material is obtained before and after the processing such as heating for image formation, it is preferable to adopt the following structure. That is, before and after the processing, an impact force is preferably applied on the same plane of the sheet material, and then the information is obtained. It is because there are some cases where the surface property or the like of one side of a sheet is different from that of the other side of the sheet. The same is true in a case of obtaining information about paper by utilizing, for example, scattered light, reflected light, or transmitted light by irradiation with light applied to the sheet material, instead of obtaining the information by applying the impact force.

Next, examples of this embodiment will be described.

First, a structure of the sheet material processing apparatus according to this example will be described.

As shown in FIG. 2, the sheet material information detecting apparatus (rear) 1 provided in the sheet material information output apparatus 1A constituting the sheet material processing apparatus according to this example includes the external force applying member 1*a* composed of the external force applying member 10, a spring 11, a cam 12, and a motor 13. Further, the sheet material information detecting apparatus (rear) 1 includes the external force detector 1*b* having a pressure sensitive element 14, a receiving member 15, a fixing member 16, and a pedestal 17. A predetermined difference in a depth direction is provided between a surface of the receiving member 15 and sheet material sliding surfaces 18 provided on the pedestal 17.

In addition, the external force detector 1*b* includes sheet material holding-down members 19 composed of a pressure bar spring and a holding-down member having a curved surface, for positioning the sheet material in a height direction of the figure by sandwiching the sheet material P between the sheet material sliding surfaces 18 and the member 19. Further, the external force detector 1*b* includes a paper end detecting sensor 20 for monitoring a position of the sheet material, in a case where the sheet material P is transported, to determine an operation timing or the like of the sheet material information detecting apparatus (rear) 1. The sheet material holding-down members 19 and the paper end detecting sensor 20 are fixed to a conveying guide 21 which is one of conveying guides 21 and 22 constituting the conveying path of the sheet material P.

As described above, the sheet material P is sandwiched between the sheet material holding-down members 19 and the sheet material sliding surfaces 18, thereby suppressing an unnecessary vibration such as flapping of the sheet material when the information about the sheet material is detected while the sheet material P is transported. Each of the sheet material holding-down members 19 is appropriately constituted of an actuator such as a spring or a solenoid for generating the force for appropriately displacing the sheet material P, and a vibration insulating material such as a rubber, or a vibration-control mechanism such as a weight having an inertial mass for suppressing the vibration of the sheet material P. In particular, the part of each of the sheet material holding-down members 19 which is in contact with the sheet material P is constituted of a material having a small friction and a high abrasive resistance.

In a case where the sheet material P is bent without tension, an unnecessary swell or bending is caused, so it is preferable that the sheet material holding-down members 19 are constituted to have an appropriate tensile tension with respect to the sheet material P. With such the structure, stable information detection can be achieved. Further, the sheet material holding-down members 19 cause deterioration such as abrasion especially by the contact with the sheet material P being transported, and is also preferable that the sheet material holding-down members 19 are structured to be saved outside the conveying path at times other than the time of detecting the sheet material information. However, the sheet material holding-down members 19 may be fixed types as long as a holding-down member having abrasive resistance is used.

In the sheet material information detecting apparatus (rear) 1 of this example with such the structure, the external force applying member 1*a* allows the external force applying member 10 consisting of, for example, a bar made of a metal having a predetermined mass, to collide with the sheet material P at a predetermined speed by accelerating by using the spring 11, and then applies an impact force to the sheet material P and the external force detector 1*b*. In this case, the mass of the external force applying member 10 is preferably about one tenth or ten times with respect to the weight in the area of the sheet material P to be measured. As an example, in a case where paper having a letter size (about 215.9×279.4 mm) whose basis weight is about 100 g/m$^2$ is to be detected, the mass of the external force applying member 10 is preferably within a range from 0.5 g to 50 g.

Further, it is necessary that a collision speed becomes a value sufficient to deform the sheet material P. Such the collision speed, as long as an object to be measured is the same as that described above, is preferably within a range from 0.05 m/sec. to 5 m/sec. which depends on the mass of the external force applying member 10 or the presence/absence of the acceleration of the gravity or the like.

In a case where the object to be measured is thin, both the mass and the collision speed of the external force applying member 10 become small values, and in a case where the object to be measured is thick, both the mass and the collision speed thereof become large. In any cases, both the mass and the collision speed of the external force applying member 10 are determined within a range in which breaking of the sheet material P is not caused, and more preferably within a range in which the sheet material P is prevented from leaving a trace by hitting and being folded. In this example, as the external force applying member 10, used is a hammer which is made of a stainless steel material (SUS316), is subjected to spherical processing, and has a mass of 4 g, and whose nose shape has a radius of 20 mm.

Further, the external force to be applied is constituted to cause impacts a plurality of times by, for example, releasing energy stored in the spring 11 by the cam 12 having a plurality of stages a plurality of times. When the respective impacts are to be caused, value of the external force (for example, a speed) may be the same, and in the case where the external forces has the same value, it is possible to enhance the accuracy of the information by performing statistical processing, for example, taking the average of the outputs at the time. It is also possible to cause a collision in a case where the value of the external force is made different. When the value of the external force is made different, reactions of the sheet materials are different from each other, thereby obtaining more multilateral information.

In this example, the sheet material detection is performed by applying the external force by using the two-stage cam 12 and the motor 13 such that the external force applying member 10 is allowed to collide with the sheet material P two times, that is, at different speeds of 0.5 mm/sec. as a high impact and 0.2 m/sec. as a low impact. Here, an interval of the two types of external force collided with the sheet material P is designed to be 0.1 sec. In addition, at the time except the two types of the external force application, especially at the time point when a leading end of the sheet material passes through a vicinity of the external force applying member 10 in association with the transportation of the sheet material P, it is designed that the external force applying member 10 is placed backward with respect to the surface of conveying guide 21 of the conveying path side in order to prevent the collision by the external force applying member 10 and the sheet material P.

In the sheet material information output apparatus 1A of this example, the sheet material information detecting apparatus (rear) 1 and the sheet material information detecting apparatus (front) 3 are separately provided, and the above-described structure are applied to both of them. In addition, in this example, the external force application and the external force detection are similarly performed in a state where there is no sheet material P, a signal generated at the time is used as a reference value.

The signal in the case where there is no sheet material is also used for detecting a state of the sheet material detecting apparatus itself. For example, in a case where the value of the signal in the case where there is no sheet material exceeds a predetermined range, it is determined that there is an error in the sheet material information detecting apparatuses 1 and 3, indicating defect, adjustment, or exchange is instructed by the signal. Alternatively, performed is a procedure in which the operation of the sheet material processing apparatus is switched to a mode in which the sheet material information detecting apparatuses 1 and 3 are not used.

When paper and the like are not used as the sheet material P, there are some cases of attaching refuse generated from paper (hereinafter, referred to as "paper powder") Alternatively, in a case where the sheet material processing apparatus is an apparatus such as a laser beam printer or a copying machine which uses fine particle toner, performance deterioration of the sheet material information detecting apparatuses 1 and 3 may occur, for example, due to scattered toner attached thereto. To deal with such the problem, an appropriate vibration is applied by the external force application with no sheet material, and the above-mentioned paper powder and toner are removed, to thereby make it also possible to perform cleaning.

Further, in this example, as the pressure sensitive element 14, used is a pressure sensitive element obtained by forming silver electrodes on both surfaces of a 0.3 mm-thick lead zirconate titanate (PZT) ceramic plate having a size of 5 mm×5 mm excluding a wiring leading-out part. As the receiving member 15, used is a plate made of a stainless steel material (SUS316) of a curved surface shape having a size of 7 mm in a direction horizontal to the sheet material transporting direction and 5 mm in a direction orthogonal to the sheet material transporting direction, a thickness of 1.5 mm at the thickest part thereof, and cross sections thereof in a horizontal direction with respect to a sheet material transporting direction have a semicylindrical shape. In addition, the pressure sensitive element 14 is adhered to the fixing member 16 made of the stainless steel material (SUS316) having a size of 5 mm×5 mm and a thickness of 1.5 mm, and is adhered to the pedestal 17 made of a PBT resin having a high slidability through the fixing member 16.

Further, in this example, the sheet material sliding surfaces 18 are provided at two parts of the pedestal 17 such that an interval (hereinafter, referred to as "width W") in a sheet material transporting direction is 10 mm, and a depth d of the step is structured to have a concave shape with a size of 0.3 mm such that a surface of the receiving member 15 (a portion opposing the end of the external force applying member 10) is lowered. Note that the step structure should have a shape that the sheet material P is bent to be transformed inside the step structure by the external force application. Such the width W and the depth d in such the structure of the step are appropriately selected in accordance with the information to be detected. A case where the depth d of the step is 0 is also included.

Further, in this example, each of the sheet material holding-down members 19 are structured such that the holding-down member made of a stainless steel (SUS316) having a curved surface is compressed by a pressure bar spring, and the sheet material P is sandwiched with the sheet material sliding surface 18.

Further, in this example, as the paper end detecting sensor 20 for monitoring a position of the sheet material P to determine an operation timing or the like of the sheet material information detecting apparatus 1, the following sensors can be used. That is, any sensor, for example, an optical photocoupler, a flap sensor of dynamics can be used without limitation as long as the sensor is capable of detecting that a leading end of the sheet material P to be used has passed.

In this example, the sheet material P to be transported in FIG. 2 passes through the paper end detecting sensor 20, and an operation timings of the sheet material information detecting apparatuses 1 and 3 are set after an appropriate time has passed since the time point in view of the conveying speed or the like. Note that the paper end detecting sensor 20 is not required in a case where the information about the sheet material P which remains stationary is detected, or in a case where the timings when the sheet material P passes through the sheet material information detecting apparatuses 1 and 3 is known in advance (for instance, in a case where a dedicated sheet material pickup mechanism is included).

Next, a sheet material information detecting operation of the sheet material information detecting apparatuses 1 and 3 according to this example will be described.

First, the external force is applied on the sheet material P by the external force applying member 1*a* (hereinafter, referred to as "Step S1"). Next, the sheet material P is bent by the applied external force, and a decelerating force is applied to the external force applying member 10 of the external force applying member 1*a* (hereinafter, referred to as "Step S2"). After that, the sheet material P is allowed to collide with the external force detector 1*b* (receiving member 15) by being integrated with the external force applying member 10, whereby the sheet material P is compressed and the external force is transmitted to the pressure sensitive element 14 through the sheet material P to be detected (hereinafter, referred to as "Step S3").

In order words, the external force applied by the external force applying member 1*a* in Step S1 is attenuated by bending/compressing the sheet material P in Step S2, to thereby be finally detected by the external force detector 1*b* in Step S3. As a result, a signal waveform of the detected external force contains information about materials such as a Young's modulus of the sheet material P and about shapes such as a thickness of the sheet material P. In addition, a restraint condition or a stress of the sheet material P is also added. When these are not necessary, detection is performed in a state where the sheet material P is as free as possible.

In this example, the detection is performed by applying the above-mentioned two types of external force, and a signal without the sheet material P is also added, thereby making it possible to detect information with high accuracy.

A certain material of the sheet material P or certain strength of the external force, and a certain shape of a groove may cause the applying member 1*a* to be rebounded before colliding with a bottom of the groove by receiving a repulsive force in Step S2. In this case, it is possible to obtain information that the sheet material has a bending rigidity of a predetermined level or more, which is within a category of the present invention.

As described above, the sheet material information detecting operations of the sheet material information detecting apparatuses 1 and 3 according to this example is described, which is only schematically shown. In an actual apparatus, members are collided or rebounded with each other a plurality of times by the vibration generated in association with the external force application, which does not interfere with the principle of the present invention.

Next, the sheet material information processing apparatus 2 constituting the sheet material information output apparatus 1A according to this example will be described. The sheet material information processing apparatus 2 processes an electric signal generated by the above-mentioned sheet material information detecting apparatuses 1 and 3. As shown in FIG. 3 described above, the value of the output voltage from the external force detector 1*b* is converted into a signal corresponding the stiffness of the sheet material to be outputted.

In FIG. 3, a value when the external force applying member 10 having a weight of 4 g is allowed to collide with the sheet material P at a speed of 0.2 m/sec. by the external force applying member la is shown as a representative example.

The sheet material information processing apparatus 2 according to this example can obtain the stiffness of the sheet material from the output voltage shown in FIG. 3 substantially using the following expression.

Stiffness of a sheet material (N)=A×output voltage (V)+B; wherein A and B are constants In the example of FIG. 3, A is about −667 and B is about −400.

Then, the information about the stiffness of the sheet material P thus obtained is distributed into an appropriate terminal voltage (for example, 0 V to 5 V) and converted to be output. The information to be outputted is not limited to this. Statistical processing such as averaging of a plurality of signals, or converting into a relative value by an output or the like generating when the external force is applied through no sheet material is also appropriately performed.

In addition, in the sheet material processing apparatus 2 of this example, processing for comparing the state of the sheet material P before being subjected to the processing with the state of the sheet material P being subjected to the processing is also preferably performed. For example, it is assumed that an apparatus for detecting the state of the sheet material P being subjected to the processing is the sheet material information detecting apparatus (rear) 1 and another sheet material information detecting apparatus for detecting the state of the sheet material P before being subjected to the processing is the sheet material information detecting apparatus (front) 3. It is preferable that an input of the sheet material information detecting apparatus (rear) 1 is compared with that of the sheet material information detecting apparatus (front) 3 to thereby output as an amount of change.

Further, for instance, in a case where the information about the change of stiffness of the sheet material before and after the fixing processing, the information from the two sheet material information detecting apparatuses 1 and 3 is treated, the treated information is converted into the amount of change of the stiffness, and the amount of change is distributed into an appropriate terminal voltage (for example, 0 V to 5 V) and is converted to be output.

In the sheet material processing apparatus 2 of this example, the treatment condition with respect to the sheet material P may be controlled by utilizing the output from the sheet material information detecting apparatus (front) 3 for detecting the state of the sheet material P before being subjected to the processing. The treatment condition is thus controlled, whereby a higher quality sheet material processing can be achieved.

In addition, in the sheet material processing apparatus 2 of this example, an amount of characteristics according to the information about the sheet material P may be outputted as information which is determined with reference to a table in which signals of the sheet material P is recorded in advance. Note that, when the signals of the sheet material P are different depending on an environmental condition, transporting condition, or the like, the determination is preferably performed based on the plurality of provided tables corresponding to a plurality of signals. Further, when the signals of the sheet material P are different depending on an environmental condition, processing for correcting the value may be performed.

In the sheet material processing apparatus 2 according to the present invention, it is also possible that the amount of characteristics or a result of the determination from the amount of the characteristics is converted to be outputted into a control value corresponding to the sheet material information by a predetermined expression. In other words, for example, in an electophotographic apparatus which is an example of image forming apparatuses, it is possible, for example, that a parameter value for controlling an electric power for heating the fixing device in accordance with a maximum generated voltage of the pressure sensitive element.

Further, the sheet material P may be determined with another means (for example, an input of model numbers of sheets to be artificially set, or a signal from a sensor separately provided) along with the above-mentioned means. Alternatively, the sheet material processing apparatus 2 may be integrated with the sheet material information detecting apparatuses 1 and 3, may be incorporated into the sheet material processing apparatus described later as a part of a CPU, or may deposit functions thereof in an external PC, a network server, or the like. In order to obtain the information about the sheet material P, every determination is not necessarily made in a processing circuit, and may be made by a person.

Next, an electrophotographic apparatus will be described as an example of the sheet material processing apparatus mounted with the sheet material information output apparatus 1A which includes such the sheet material information processing apparatus 2 and the sheet material information detecting apparatuses 1 and 3.

FIG. 1 shows a structure of the electrophotographic apparatus (sheet material processing apparatus) including at least the sheet material information output apparatus 1A, the processing control unit 1B for determining and controlling the treatment condition based on the information from the sheet material information output apparatus 1A, a processing unit 7 for performing a part of or all of the processing with respect to the sheet material P.

In this case, the sheet material information output apparatus 1A has the above-described structure. The processing control unit 1B includes at least a control unit (CPU) 4 for determining the treatment condition based on the information from the sheet material information output apparatus 1A, and a processing drive circuit 5 for actually driving the processing unit 7. Further, the processing control unit 1B exchanges information with an external PC and the like 8 as necessary.

The processing unit 7 is described as the fixing device 7 in FIG. 1, but it is not limited this. The processing unit 7 includes a processing unit for performing the processing of the sheet material P such as transportation of the sheet material P, transferring of toner, fixation, stacking, and book-binding, or includes all the processing units.

Next, a first example of the sheet material processing method in the electrophotographic apparatus with such the structure will be described with reference to a flow chart shown in FIG. 4.

The processing method is an example in which, in a case where the processing is performed with respect to a particular sheet material Pn (n is a positive integer) and a sheet material Pn+m (n and m are positive integers) to be treated subsequently, the information about the sheet material Pn being subjected to the processing is detected, and then the treatment condition of the sheet material Pn+m to be treated subsequently is controlled based on the detected information. In other words, this example is an example of processing such as a serial copy using a plurality of sheet materials. In the electrophotographic apparatus, a change of the sheet material P after the fixing processing becomes large, which will be described below as an example.

Step 1: Obtain Information of the Sheet Material Pn Before Processing

In this step, the sheet material information detecting apparatuses 1 and 3 are operated with no sheet material, a signal of no sheet material is obtained, and the signal is stored as a reference signal. In the following step, a value is calculated by comparing the reference signal. Subsequently, the sheet material Pn is transported, the information of the sheet material Pn before being subjected to the processing is obtained to be outputted by the sheet material information processing apparatus 2.

Step 2: Subject the Sheet Material Pn To The Processing

In this step, the sheet material Pn is subjected to the fixing processing, and the processing may be the whole series of processing which ends up with steps that an image is formed on a blank sheet material and the sheet is delivered and bound to discharge as a resultant. Alternatively, the processing may be each step in the series of processing such as stocking sheet materials, transportation, aligning of leading ends, data processing of printing images, transferring of color materials, fixation, discharging, stacking, or binding. The treatment condition of this step is preferably determined based on the information of the sheet material Pn which is obtained in Step 1.

Step 3: Detect Information of the Sheet Material Pn after the Processing

In this step, similarly to the description of Step 1, the information of the sheet material Pn after being subjected to the processing is obtained to be outputted by the sheet material information processing apparatus (rear) 1. In this case, there are some cases where the change of the sheet material being subjected during the processing is returned in a short period of time by standing. For example, when water evaporates during the fixing processing, the recovery has began since the moment of being out of the fixing processing and into an environment within the processing apparatus, and saturation is generally obtained in a several seconds to a several minutes. As a result, in such the case, the information is preferably detected immediately before Step 4 subsequently described.

Step 4: Treat Information of the Sheet Material

In this step, the information necessary for determining the control value of the electrophotographic apparatus is extracted based on the information of the sheet material Pn which is obtained in Step 3 or in Steps 1 and 3. In this case, for example, a change in rigidity of the sheet material P before and after the fixing processing is detected, and the amount of change is outputted. Note that statistical processing of average values or accumulated information is appropriately performed.

Step 5: Determine and Output the Control Value of the Electrophotographic Apparatus for the Processing In this step, based on the information obtained in Step 4, the control value for the processing is determined to be outputted. In this case, the control value means a condition each of the units for performing the processing. Taking the fixing processing as an example, a warm-up temperature when the electrophotographic apparatus is activated, a start-up control when printing is instructed, a temperature control profile when the sheet material P passes therethrough, and reheat and temperature control profiles when the processing is consecutively performed are included. Further, included are a lot of items such as a speed and intervals at which the sheet materials P pass through the fixing device 7, (in a case of cut sheets).

Further, it is preferable that the whole electrophotographic apparatus is controlled. In this case, as a control value, it is preferable that the whole operation of the electrophotographic apparatus is adjusted. In other words, in addition to the conditions such as transportation, transferring, and fixing, the following conditions are added as necessary. That is, it is preferable to add such conditions as adjusting image data to be printed, the whole management of the speed of operation, print interval, and the like, correcting curl of sheets, stacking, binding, or stapling of the sheet materials after being printed to adjust as a whole to obtain an appropriate value. Note that, it is preferable that the control value is automatically controlled by the electrophotographic apparatus.

When the control value is determined, the following should be considered. That is, the change of the sheet material P is caused during the processing, separately from the original processing. The change is resulted from mechanical stress such as moisture absorption or drying when stocked, or bending or friction when transported. In addition, there are caused a change of thickness or the like due to transferring of color materials (similarly, in a case of an ink jet printer, a change in rigidity due to the absorption of water or the like contained in ink), a change in water evaporation, rigidity, or thickness due to being heated and pressurized at fixation. As a result, when the control value is determined, it is preferable that the value is determined such that the changes are reduced as much as possible within a range in which during the processing to be originally performed, for example, in a case of fixation, the degree of fixing of color materials is excellent.

Step 6: Subject the Sheet Material Pn+m to the Processing

In this step, the sheet material Pn+m is subjected to the processing based on the control value obtained in Step 5.

Step 7: Change the Treatment Condition of the Electrophotographic Apparatus for the Processing In this step, the treatment condition for the processing is changed based on the control value obtained in Step 5. The change may be made only once in the steps mentioned above, or obtaining of the information and change of controlled condition may be repeatedly performed at each time when the processing of the sheet material P is performed. In addition, it is more preferable that the treatment condition is sequentially improved by an analysis in which a history of obtained information is recorded, and statistical processing is further performed, to thereby return to an appropriate value with respect to the electrophotographic apparatus and the sheet material P.

As a preferable control of the processing of the electrophotographic apparatus which is adapted to this example, there is, for example, a control of values of electric power to be supplied to the fixing device 7. For instance, the stiffness of the sheet material P is changed by being heated and pressurized during the step of fixation (in many types of paper, the stiffness thereof is increased, and in a resin sheet or the like, the stiffness thereof is reduced by softening). In accordance with the amount of change, the treatment condition is determined. For example, in a case where the stiffness is increased to a predetermined level or more, the electric power to be supplied to the fixing device is suppressed, to thereby preventing the stiffness from excessively increasing.

Further, as another preferable control of the processing of the electrophotographic apparatus, there is, for example, a control of transporting condition. That is, in cases where the sheet material P is softened or the like by being heated in the processing, transportation is stopped once to wait until the temperature is lowered, and when recovered from the softening, the processing proceeds to the subsequent processing.

When the sheet material P has been treated in the step, an appropriate image in which toner is excellently fixed is formed. In addition, the stiffness of the sheet material P is controlled within a predetermined range, and the subsequent steps are also normally performed. Further, a texture of the sheet material P is prevented from being impaired to a large extent, thereby making it possible to perform the preferable sheet material processing.

The above-mentioned Step 1 may be obtained by assuming to some extent by, for example, inputting a model number of the sheet material P in advance, or adding temperature, humidity, or the like measured by a separate sensor to the information. Such the case is shown in a flow chart of FIG. 5 which is a second example of the sheet material processing method. In the flow chart shown in FIG. 5, Step 1 of the flow chart of FIG. 4 is omitted, and step numbers of the following steps are moved forward. However, details of the corresponding steps are substantially the same as those of the flow chart of FIG. 4, so the description thereof will be omitted.

Figure 6:
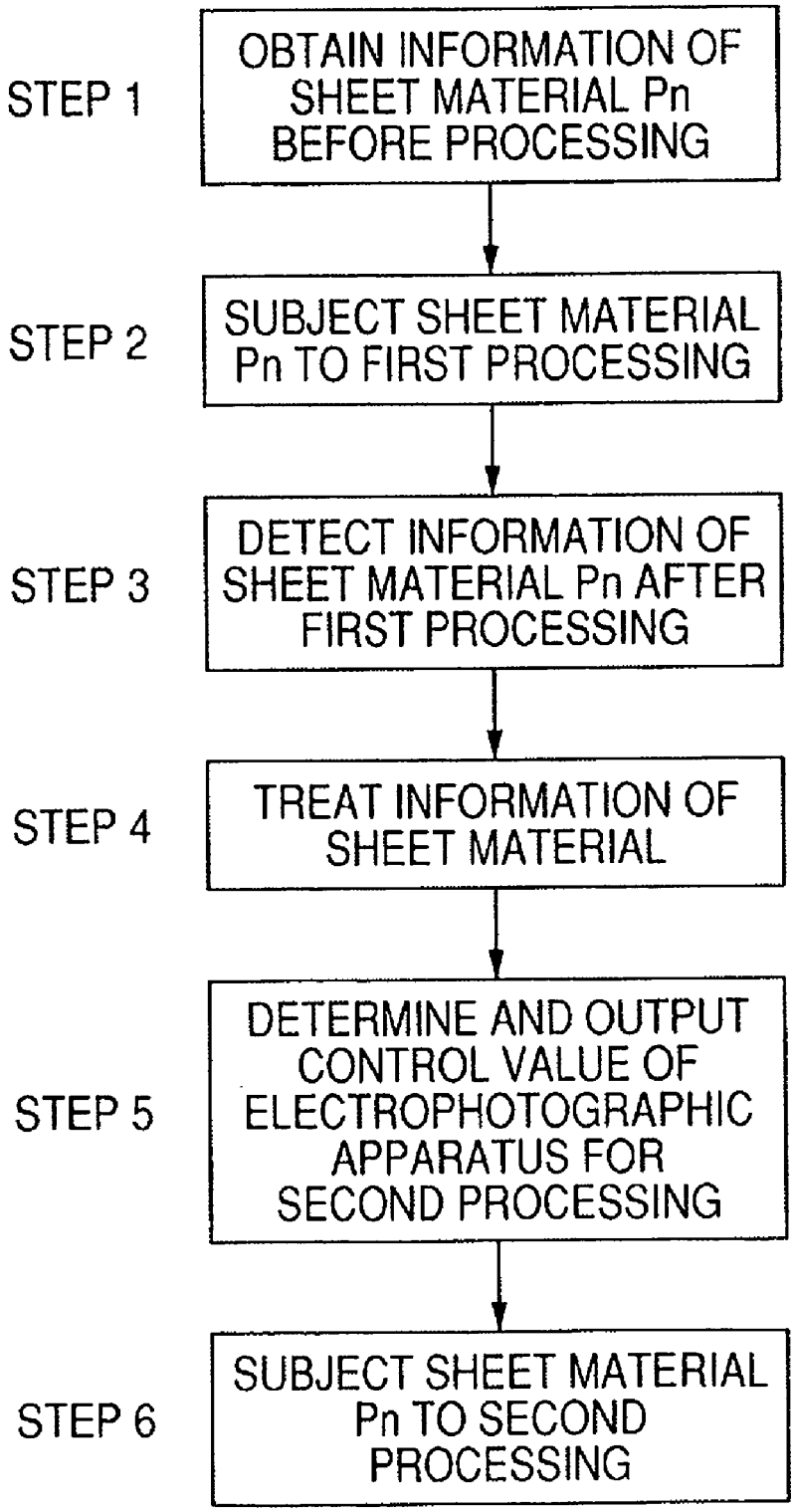
FIG. 6 is a flow chart according to a third example of the sheet material treating method in the electrophotographic apparatus according to the present invention.

Next, a third example of the sheet processing method in the electrophotographic apparatus will be described with reference to a flow chart of FIG. 6. In the example, in a case where a plurality of processing is performed with respect to a particular sheet material Pn (n is a positive integer), the information of the sheet material Pn being subjected to the processing is detected to control the treatment conditions of the subsequent processing based on the information. In other words, this example is an example of processing such as a double-sided copy in which image formation is performed twice with respect to one sheet material. Among the steps, Steps 1, 3, 4, and 6 are similar to the steps shown in FIG. 4 whose outlines have been already mentioned, so that the description thereof will be omitted.

Step 1: Obtain Information of the Sheet Material Pn Before the Processing

Step 2: Subject the Sheet Material Pn to a First Processing

In this step, the sheet material Pn is subjected to first processing of image formation. The first processing is the image formation for one side of the double-sided copy. In addition, the first processing may be each step of image formation, such as stocking the sheet material P, transportation, aligning of leading ends, data processing of printing images, transferring of color materials, fixation, discharging, stacking, or binding during the image formation for one side of the double-sided copy. Note that the treatment condition of each of these steps is preferably determined based on the information of the sheet material Pn which is obtained in Step 1.

Step 3: Detect Information of the Sheet Material Pn After the First Processing

Step 4: Treat Information of the Sheet Material

Step 5: Determine and Output the Control Value of the Electrophotographic Apparatus for a Second Processing In this step, based on the information obtained in Step 4, the control value for the second processing is determined to be outputted. In this case, the control value of the subsequent second processing is determined based on the information of the change or the like of the sheet material P after being subjected to the previous processing when a plurality of processing is performed with respect to the sheet material P.

For example, in the processing of double-sided copy, in a case where the stiffness of the sheet material P is excessively increased when one side of the sheet is fixed in the image formation, the temperature of the fixing device is lowered to a certain degree by reducing the amount of electric power supplied to the fixing device so that the increase in stiffness is suppressed in the fixing condition for the other side, whereby an excessive evaporation of water is prevented. It is also within a category of the present invention that, for example, expansion and contraction of image data to be formed is performed, for example, by estimating a shrinkage or the like of the sheet material P based on the converted decrease in the amount of water due to evaporation by the increase in stiffness.

Figure 4:
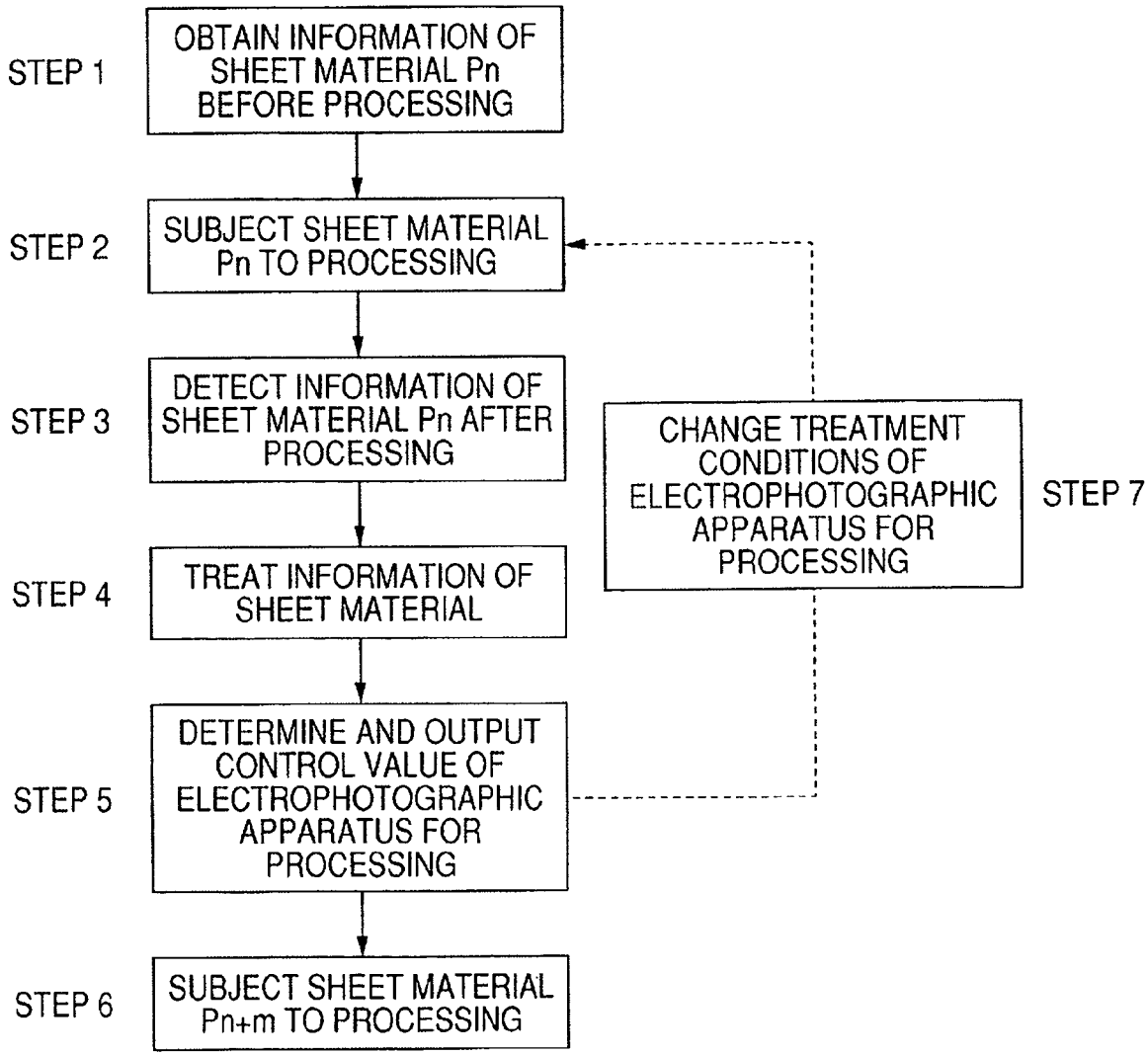
FIG. 4 is a flow chart according to a first example of a sheet material treating method in an electrophotographic apparatus according to the present invention.
Figure 5:
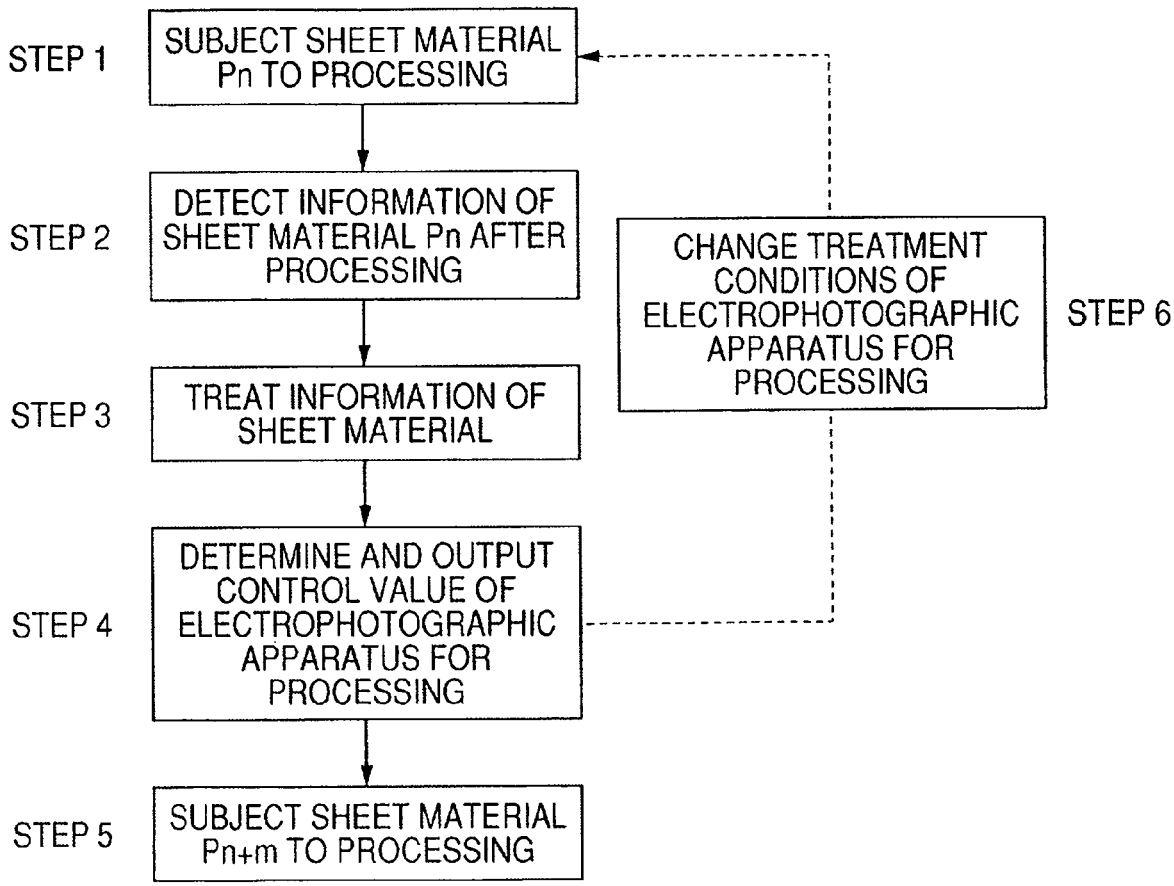
FIG. 5 is a flow chart according to a second example of the sheet material treating method in the electrophotographic apparatus according to the present invention.

Specific control value is similar to the above-mentioned case of the flow chart shown in FIG. 4.

Step 6: Subject the Sheet Material Pn to the Second Processing

As a processing control, in addition to the control of the double-sided copy, there is, for example, a control of the voltage to be supplied for transferring. In this case, the transferring voltage value is determined in accordance with the value of resistance of the sheet material. For example, when paper is used as the sheet material P, water is evaporated by heating in the step of fixation of the first processing of the sheet material P, and the resistivity is changed and the stiffness is increased. The change of the amount of stiffness is detected and converted into a change of the moisture content, thereby making it possible to control the optimum transferring condition.

In recent years, for an image forming apparatus which performs processing such as image formation, image reading, transportation, image fixing, or the like to a medium such as the sheet material, and a sheet material processing apparatus such as a printer, a facsimile, or the like, the following measures are taken. In other words, as demands on high-quality images and high-speed processing performance are increased, it is intended that the information regarding the processing is obtained by using various sensors to optimize the treatment condition by using the obtained information.

However, in such the conventional sheet material processing apparatus, it is required that a sheet material after the processing, an image formed on the sheet material, and the like, which are resultants of the processing be in high quality. For instance, in the fixing processing, there are cases where paper quality is considerably deteriorated by the change in stiffness, curling, and the like, because the change of the sheet material varies depending on the type or state of the sheet material even under the same condition.

In particular, such the problem is serious in an apparatus in which the processing is performed a plurality of times with respect to the sheet material, for example, making a color copy in which images with a plurality of colors are overwritten or a double-sided copy, or in an apparatus in which the processing is performed with respect to the same type of sheet material in large quantity, for example, making a continuous copy. Further, such the problem is also serious in an apparatus in which a processing such as bookbinding or the like is performed with respect to the sheet material.

The sheet material information processing apparatus 2 according to the second embodiment is structured and controlled in view of the above situation, and provides an image forming apparatus capable of performing excellent sheet material processing. In other words, in the image forming apparatus, it is possible to detect the information of the sheet material P being subjected to the processing by the sheet material information detecting apparatus 1, detect the change of the sheet material P for the processing, and control the processing, to perform the excellent sheet material processing.

<Correspondence with the Invention>

The sheet material information output apparatus 1A includes the external force applying member 10 for applying the external force to the sheet material P, and the external force detector 1*b* for detecting the external force applied by the external force applying member 10 through the sheet material P. The sheet material information output apparatus 1A further includes the sheet material information treating apparatus 2 for obtaining information of the sheet material P based on a detected result of the external force detector 1*b*. The external force detector 1*b* includes the pressure sensitive element 14 for outputting an electric signal corresponding to the compression force acting in the thickness direction. The external force detector 1*b* further includes the receiving member 15 for receiving the external force applying member 10 through the sheet material P to act the compression force on the entire surface of the pressure sensitive element 14, and the fixing member 16, integrally fixed to the pressure sensitive element 14 with interposition of the pressure sensitive element 14 between the receiving member 15 and the fixing member 16, for resisting the bending strength acting on the pressure sensitive element 14.

The sheet material information processing apparatus 2 of the sheet material information output apparatus 1A detects the external force applied to the sheet material P before being subjected to the processing, and the external force applied to the sheet material P after being subjected to the processing.

The sheet material information processing apparatus 2 of the sheet material information output apparatus 1A detects the amount of change of the state of the sheet material P during the processing based on the information of the sheet material P before being subjected to the processing and the information of the sheet material P being subjected to the processing. Then, based on the detected amount of change, the information of the sheet material P is detected to be outputted.

The sheet material information output apparatus 1A includes another sheet material information detecting apparatus 3 for detecting the information of the sheet material P before being subjected to the processing.

The sheet material information detecting apparatus 1 allows the external force applying member 10 to collide with the surface of the sheet material P and detect the impact force received by the receiving member 15 through the sheet material P by the pressure sensitive element 14. With the structure in which the pressure sensitive element 14 is sandwiched between the receiving member 15 and the fixing member 16, the pressure sensitive element 14 is solely deformed by compression so that the pressure sensitive element 14 is less deformed by bending due to the impact force. The sheet material information processing apparatus 2 detects a voltage signal outputted from the pressure sensitive element 14 by the deformation by compression, to thereby discriminate the sheet material P based on the detected voltage signal.

The sheet material information output apparatus 1A can be mounted to an image forming apparatus. Such the image forming apparatus includes a processing unit for performing the processing of image formation with respect to the sheet material P, and controls the sheet material treatment condition of the processing unit in accordance with the sheet material information outputted from the sheet material information output apparatus 1A.

In the sheet material discrimination apparatus according the present invention, the bending rigidity of the piezoelectric element is considerably reinforced by the support member, whereby forces other than compression are less acted on the piezoelectric element. The output of the piezoelectric element depends on the compression force received by the pressure receiving surface of the piezoelectric element, and the output resulting from a slip, shearing, or bending becomes considerably small as compared with the case of no the support member.

Therefore, noises due to the bending vibration of the piezoelectric element caused by the impact are eliminated, and the measurement SN ratio is considerably enhanced as compared with the case where the piezoelectric element is allowed to be arbitrarily deformed by bending. The bending vibration of the piezoelectric element caused by the friction with the sheet material also becomes small, thereby making it possible to obtain the output high in reproducibility irrespective of a surface property and a material of the sheet material, and discriminate the sheet material with accuracy even when the sheet material is transported at a high speed.

In addition, the cushioning material is not directly brought in contact with the piezoelectric element, so that the property change of the cushioning material with the elapse of time or by temperature change is less affected to the output of the piezoelectric element. Therefore, the cushioning material can be selected from a wide range of options, thereby making it possible to design even a thin cushioning material such that the effects of preventing noises and vibrations are enhanced.

This application claims priority from Japanese Patent Application Nos. 2005-163766 filed Jun. 3, 2005 and 2006-116231 filed Apr. 19, 2006, which are hereby incorporated by reference herein.

What is claimed is:

1. A sheet material discrimination apparatus comprising:

an impact force applying member for colliding with a surface of a sheet material;

an impact force receiving member for receiving the impact force applying member through the sheet material;

a detecting unit for outputting an electric signal corresponding to an impact force received by the impact force receiving member; and a cushioning material for absorbing the impact force transmitted to the detecting unit;

wherein a support member having a bending rigidity higher than a bending rigidity of the detecting unit with respect to the impact force is arranged between the detecting unit and the cushioning material.

2. A sheet material discrimination apparatus according to claim 1, wherein the support member is fixed to the detecting unit on a planer area in which the impact force receiving member is fixed to the detecting unit.

3. A sheet material discrimination apparatus according to claim 1, the support member has a mass larger than a mass of the impact force receiving member.

4. A sheet material discrimination apparatus according to claim 1, wherein the support member has a bending rigidity higher than a bending rigidity of the impact force receiving member with respect to the impact force.

5. A sheet material discrimination apparatus according to claim 1, wherein the support member is formed of a material having at least Young's modulus of 100 Gpa.

6. An image forming apparatus comprising an image forming unit for forming an image on a sheet material, wherein a sheet material discrimination apparatus according to claim 1 is arranged on a sheet material conveying path placed at an upper stream side of the image forming unit; and wherein there is provided a controller for controlling the image forming unit corresponding to a discrimination result of a sheet material obtained by the sheet material discrimination apparatus.

7. A sheet material information output apparatus, comprising:

an external force applying member for applying an external force to a sheet material;

an external force detector for detecting an external force applied from the external force applying member through a sheet material; and a sheet material information treating apparatus for obtaining information about the sheet material on a basis of a detection result of the external force detector, wherein the external force detector comprises:

a detecting unit for outputting an electric signal corresponding to a compression force acted in a thickness direction;

a receiving member for receiving the external force applying member through the sheet material to allow the compression force to effect the detecting unit; and a fixing material, integrally fixed to the detecting unit so that the detecting unit is interposed a gap between with the receiving member and the fixing material, for resisting a bending strength acting on the detecting unit.

8. A sheet material information output apparatus according to claim 7, wherein the sheet material information treating apparatus detects an external force applied to a sheet material before being subjected to a processing, and an external force applied to a sheet material after being subjected to the processing.

9. A sheet material information output apparatus according to claim 8, wherein a change amount of a state of the sheet material during the processing is detected on a basis of information about a sheet material before being subjected to a processing, and information about a sheet material after being subjected to the processing, and information about the sheet material is detected and outputted on a basis of the detected change amount.

10. A sheet material information output apparatus according to claim 9, further comprising another sheet material detecting apparatus for detecting information about the sheet material before being subjected to a processing.

11. An image forming apparatus comprising:

a sheet material information output apparatus according to claim 7; and a processing unit for applying a processing to a sheet material, wherein a sheet material treating condition of the processing unit is controlled corresponding to sheet material information outputted from the sheet material information output apparatus.

* * * * *